US010301838B1

(12) United States Patent
Karakas

(10) Patent No.: US 10,301,838 B1
(45) Date of Patent: May 28, 2019

(54) METAL SKELETON FOR THE REINFORCEMENT OF VERTICALLY ELONGATED CONCRETE STRUCTURES

(71) Applicant: Kach Inc., Burlington, Ontario (CA)

(72) Inventor: Milan Karakas, Burlington (CA)

(73) Assignee: Kach Inc., Burlington, Ontario (CA)

( * ) Notice: Subject to any disclaimer, the term of this patent is extended or adjusted under 35 U.S.C. 154(b) by 0 days.

(21) Appl. No.: 15/969,485

(22) Filed: May 2, 2018

Related U.S. Application Data

(60) Provisional application No. 62/583,629, filed on Nov. 9, 2017, provisional application No. 62/642,187, filed on Mar. 13, 2018.

(51) Int. Cl.

| | |
|---|---|
| ***E04H 12/22*** | (2006.01) |
| ***E04B 1/16*** | (2006.01) |
| ***E04C 5/06*** | (2006.01) |
| ***E04G 21/12*** | (2006.01) |
| ***E04C 3/34*** | (2006.01) |
| ***E04H 12/34*** | (2006.01) |
| ***E04B 1/30*** | (2006.01) |

(52) U.S. Cl.
CPC ..... *E04H 12/2269* (2013.01); *E04B 1/165* (2013.01); *E04B 1/167* (2013.01); *E04B 1/30* (2013.01); *E04C 3/34* (2013.01); *E04C 5/06* (2013.01); *E04C 5/0604* (2013.01); *E04C 5/0609* (2013.01); *E04C 5/0622* (2013.01); *E04G 21/12* (2013.01); *E04H 12/341* (2013.01)

(58) Field of Classification Search
CPC ... E04G 21/12; E04H 12/2269; E04H 12/341; E04C 5/06; E04C 5/0604; E04C 5/0609; E04C 5/0622; E04C 3/34; E04B 1/167; E04B 1/165; E04B 1/30
See application file for complete search history.

(56) References Cited

U.S. PATENT DOCUMENTS 1,879,207 A * 9/1932 Gupwell ..... E04C 5/06 404/134
3,333,386 A * 8/1967 Mora ..... E04C 5/06 114/74 A (Continued)

FOREIGN PATENT DOCUMENTS

GB 343803 A * 2/1931 ..... E04C 5/06
WO WO-2009024623 A2 * 2/2009 ..... E04C 3/34

*Primary Examiner* — Adriana Figueroa
*Assistant Examiner* — Jessie T Fonseca
(74) *Attorney, Agent, or Firm* — Patrick J. Hofbauer

(57) ABSTRACT

A metal skeleton for the reinforcement of a vertically elongated concrete structure has a first plurality of leg members each having top and bottom ends and inner and outer side edges together defining a leg body portion. A first plurality of rib plate engagement slots are formed in at least one of the inner side edge and the outer side edge. Each of the leg members is formed from a flat sheet of metal material. A first plurality of rib plates each define a generally planar central body portion and each have a first plurality of leg-engagement slots projecting into the central body portion. The leg-engagement slots are dimensioned and adapted to frictionally engage with respective ones of the rib plate engagement slots. The first plurality of leg-engagement slots slidingly interfit within respective ones of the first plurality of rib-engagement slots to securely connect the rib plates to the leg members to form the metal skeleton.

38 Claims, 24 Drawing Sheets

(56) References Cited

U.S. PATENT DOCUMENTS

| | | | | |
|---|---|---|---|---|
| 8,484,915 | B1 * | 7/2013 | Abbas | E04C 3/34<br>405/232 |
| 2007/0278380 | A1 * | 12/2007 | Marker | E04C 3/34<br>249/189 |
| 2008/0222976 | A1 * | 9/2008 | Liskey | E02D 27/12<br>52/169.9 |
| 2009/0282753 | A1 * | 11/2009 | Kuan | E04B 1/30<br>52/167.1 |

* cited by examiner

METAL SKELETON FOR THE REINFORCEMENT OF VERTICALLY ELONGATED CONCRETE STRUCTURES

FIELD OF THE INVENTION

The present invention relates to a metal skeleton for the reinforcement of vertically elongated concrete structures to be formed therearound, and more particularly to such a skeleton that can be quickly assembled with unprecedented ease and accuracy on a construction site from pre-formed metal components.

BACKGROUND AND SUMMARY OF THE INVENTION

Vertically elongated structures, such as pillars, poles, posts, pylons, bollards and the like are commonly formed from reinforced concrete. Similarly, vertically elongated concrete structures in the form of footings or bases may be constructed from reinforced concrete and used to support thereon other structures such as decks, floors, walls, verandahs, roofs, poles, pillars, posts, lintels, monuments, etc.

In all such applications, the vertically elongated concrete structures may optionally be positioned, at least partially, below grade, depending upon the particular application and local building codes.

Vertically elongated concrete structures of the prior art typically have a concrete main body portion that is reinforced with metal reinforcing bar ("rebar") contained therewithin to increase its strength. Further, one or more metal connection means, such as, for example, threaded rods, may optionally be arranged in a pattern to project upwardly from the top of the vertically elongated concrete structure to be received in cooperating engagement with the base plate, sole plate, lintel, cross-beam, or other co-operating portion, of a deck, floor, wall, verandah, roof, pole, pillar, post, monument, or other structure that is to be supported atop the vertically elongated concrete structure.

Where rebar is used for reinforcement of a vertically elongated concrete structure as aforesaid, a plurality of individual pieces of rebar may be connected together before concrete is poured therearound to form a unitary reinforcement skeleton, which process is, inter alia, both tedious and time-consuming and may require skilled or semi-skilled labor to complete satisfactorily. Accordingly, such reinforcement of vertically elongated concrete structures using rebar may not be particularly suited for completion by inexperienced or unskilled laborers, such as homeowners, or other do-it-yourselfers.

Among the numerous problems typically encountered when using rebar to construct a reinforcement skeleton for vertically elongated concrete structures of the type mentioned hereinabove, many stem from the fact that rebar is typically made available (like construction lumber) in bulk in the form of standard lengths, such that it must be cut to size on the job site for subsequent use in assembling a reinforcement skeleton. As such, there is typically little or no pre-engineering that goes into the design or building of such re-enforcement skeletons, and much happenstance as to how they are constructed on site. In short, quality control is substantially hit and miss, and dependent to an unacceptably large extent upon the experience and skill of the workers who fabricate the reinforcement skeleton from bulk materials on site.

Also, on-site cutting typically requires the use of cutting torches and/or high-powered metal cutting saws under the less than ideal conditions that typically exist at open air construction sites where concrete is to be poured. Such tools are expensive to own and dangerous to operate, and are subject to theft or damage on construction sites.

Additionally, as alluded to above, there is a need for at least semi-skilled labour to carry out the process of accurately and efficiently fabricating rebar reinforcement skeletons, as such labour must be able to accurately measure and safely operate the cutting tools necessary to cut the rebar to the various lengths required for assembly of the reinforcement skeleton prior to it being inserted into a hole in the ground, or into a hollow form structure, used to retain concrete around the reinforcement structure after pouring of the concrete.

If hired labor is retained to fabricate the rebar reinforcement skeleton, such labor is expensive and not always readily available when needed. If this operation is being carried out by a homeowner or a do-it-yourselfer, such labor is typically inexperienced in the task at hand so as to produce inconsistent results.

Furthermore, after cutting to the required lengths, a plurality of rebar sections must be assembled and connected together to form the internal reinforcement skeleton by means of supplemental fastening means, which can include, without limitation, clips, clamps, wire, threaded fasteners, and/or welding. The need for supplemental fastening means not only significantly adds to the cost of producing prior art metal reinforcement skeletons from rebar, but significantly lengthens the time to produce such skeletons. Moreover, the acquisition, set-up and use of welding equipment to complete this task is expensive, time consuming, and is subject to injury or other mishap, and to theft or damage from construction sites.

Even with the proper tools and labour on hand, the production of internal reinforcement skeletons from rebar on a typical construction site is slow and difficult, due in significant part to the harsh and adverse working conditions that typically exist at such open-air construction sites where concrete is being poured. These conditions commonly include the lack of cover from rain, wind and cold, and the lack of clear and even work surfaces and spaces for measuring, cutting and assembly of the metal skeleton. Such adverse working conditions introduce the significant possibility of errors being made and/or shortcuts being taken.

Additionally, reproduction of a plurality of substantially identical metal reinforcement skeletons is required for some projects. Maintaining dimensional accuracy of prior art metal reinforcement skeletons across such a plurality of structures is particularly difficult under the adverse working conditions available at typical open-air construction sites.

Further, prior art metal skeletons assembled according to the prior art from rebar can easily be bent, or otherwise deformed, from their intended shape either during, or after, assembly.

Fabrication of metal reinforcement skeletons from rebar also involves significant expense and logistics problems in procuring all of the necessary materials and assembly equipment from various sources and shipping same, in a secure and timely manner, to a construction site. These problems include, without limitation, the nearly inevitable chance of materials or assembly equipment not arriving at, or disappearing from, a construction site, the lack of protection from weather and other agents of metal materials stored at a construction site, the lack of ready access by workers to plans for assembling the metal skeleton.

Also, with prior art vertically elongated concrete structures, there exists a significant potential problem with respect to alignment of any connection means projecting upwardly from the top of the vertically elongated concrete structure with co-operating receiving means positioned on a base plate or other co-operating receiving means that is to be supported on the vertically elongated concrete structure. This can be particularly problematic where the connection means includes a plurality of threaded rods projecting in a pattern upwardly from the vertically elongated concrete structure to mate with a co-operating pattern of apertures in the base plate, sole plate or other mating portion of a deck, verandah, wall, floor, roof, pole, pillar, post, lintel monument, pylon, bollard or the like to be mounted atop the vertically elongated concrete structure. In such instance, and particularly where the plurality of upwardly extending threaded rods are anchored for added strength to the metal reinforcement skeleton, such reinforcement structure must be fabricated with considerable dimensional accuracy in order to ensure that the threaded rods each mate with the respective holes pattern formed in the base plate, sole plate or other mating component of the deck, floor, verandah, roof, pole, pillar, post, lintel, etc., and, most importantly, also have their longitudinal axis aligned with true vertical, so as to ensure that the structure to be mounted atop the vertically elongated concrete structure is itself aligned with true vertical. Building a rebar reinforcement skeleton with such dimensional accuracy is not easily achievable, particularly by homeowners, do-it-yourselfers, or other inexperienced personnel.

In order to provide an outer peripheral barrier to retain the uncured concrete as it is poured to form an elongate vertically elongated concrete structure, a cylindrically shaped non-metal casting form is often used. One such readily available non-metal casting form is commercially marketed under the trademark Sonotube™, by SPC Resources Inc., of Delaware, USA. Depending upon, inter alia, the size of the elongate vertically elongated concrete structure that is to be formed, and the weight it is to bear, rebar may, or may not, be used with a Sonotube™ casting form. While the Sonotube™ casting form works well and is widely used, it does nothing to address the known prior art problems associated with forming vertically elongated concrete structures, such as time and costs associated with the formation of a rebar reinforcement structure, and the aforementioned problem of alignment of a pattern of upwardly projecting fastening means, such as threaded rods. Furthermore, it may be necessary in some circumstances to use a substantial banding or bracing structure in conjunction with a Sonotube™ casting form in order to bear the lateral forces associated with the weight of the uncured concrete in order to preclude the Sonotube™ casting form from deforming or even rupturing. Also, a substantial banding or bracing structure may be necessary in some applications in order to ensure that the body of the vertically elongated concrete structure stricture and/or any rebar used therein remains truly vertically oriented so as to ensure that any structure mounted atop such vertically elongated concrete structure is similarly truly vertically oriented.

It is also known in the prior art to use a footing form in conjunction with a cylindrically shaped non-metal casting form such as a Sonotube™ in order to support the casting form from below. One such prior art footing form can be found in issued U.S. Pat. No. 6,840,481 issued Jan. 11, 2005 to Swinimer and entitled Footing Form. The bell-shaped footing form is for use during the pouring of a footing for a structural pillar and is preferably constructed from a thermoplastic such as a high density polyethylene or ABS. The footing form encases and supports the bottom portion of the cylindrically shaped non-metal casting form. While this footing form does help support the cylindrically shaped non-metal casting form during the pouring of concrete, it does not fully support the cylindrically shaped non-metal casting form over its entire height, and does not address the aforementioned problems associated with the use of rebar, including the alignment of threaded rods into cooperating apertures in a base plate to be mounted thereon.

Other relevant known prior art can be found in U.S. Pat. No. 9,284,744 issued Mar. 15, 2016 to Patterson et al. and entitled Modular Concrete Pole Base. The pole base disclosed in this patent provides a secure mounting structure that can easily be adapted for use with multiple configurations of poles and includes a concrete body having metal rebar therein, which is well known in the art. A load-bearing pole attachment comprises a metal plate disposed on, or within, the upper portion of the body and is configured to removably receive a plurality of fasteners. The fasteners are used to secure a pole on the load-bearing pole attachment. The concrete body may include a central cavity for receiving conduit and the like therethrough. As is typical with such prior art pole base structures, the Patterson et al. structure requires a significant amount of forming and fastening of rebar.

According to one object of the present invention, there is provided a metal skeleton for the reinforcement of a vertically elongated concrete structure for supporting decks, floors, verandahs, roofs, poles, pillars, posts, lintels and the like, the components of which skeleton are all pre-engineered and pre-cut when received by an end-user.

According to another object of the present invention, there is provided a pre-engineered metal skeleton for the reinforcement of a vertically elongated concrete structure, wherein the rebar components of the metal skeleton do not need to be cut to size on a job site for subsequent use in assembling the reinforcement skeleton.

According to another object of the present invention, there is provided a skeleton for the reinforcement of a vertically elongated concrete structure, wherein metal skeleton is capable of being pre-engineered to exacting standards of dimension, rigidity strength and quality control.

According to another object of the present invention, there is provided a metal skeleton for the reinforcement of a vertically elongated concrete structure, wherein the strength, quality and dimensional accuracy of the metal skeleton is not dependent upon the experience and skill of those assembling the skeleton.

According to another object of the present invention, there is provided a metal skeleton for the reinforcement of a vertically elongated concrete structure, which metal skeleton need not be formed de novo each time from bulk materials cut at a construction site and that is easily replicated with dimensional accuracy.

According to another object of the present invention, there is provided a metal skeleton for the reinforcement of a vertically elongated concrete structure, wherein formation of the metal skeleton does not require the use of cutting torches and/or high-powered metal cutting saws.

According to another object of the present invention, there is provided a metal skeleton for the reinforcement of a vertically elongated concrete structure, wherein formation of the pre-engineered metal skeleton does not require the use of tools that are expensive to own and dangerous to operate, and that are subject to theft, or damage, on construction sites.

According to another object of the present invention, there is provided a metal skeleton for the reinforcement of a vertically elongated concrete structure, wherein formation of the metal skeleton can be done without the need of skilled or semi-skilled labour.

According to another object of the present invention, there is provided a metal skeleton for the reinforcement of a vertically elongated concrete structure, wherein formation of the metal skeleton can be carried out without the need for supplemental fastening means such as clips, clamps, wires threaded fasteners, and/or welding.

According to another object of the present invention, there is provided a metal skeleton for the reinforcement of a vertically elongated concrete structure, wherein the components of the metal skeleton can be readily procured and securely shipped from a single source to a construction site in a standard shipping container.

According to another object of the present invention, there is provided a metal skeleton for the reinforcement of a vertically elongated concrete structure, wherein assembly of the metal skeleton can be carried out readily and quickly with predictable results in adverse working conditions including the lack of cover from rain, wind and cold, and the lack of clear and even work surfaces and spaces for measuring, cutting and assembly.

According to another object of the present invention, there is provided a skeleton for the reinforcement of a vertically elongated concrete structure, which significantly reduces the likelihood of dimensional errors in the concrete structure formed therearound.

According to another object of the present invention, there is provided a metal skeleton for the reinforcement of a vertically elongated concrete structure, which metal skeleton significantly reduces the possibility of errors being made and/or shortcuts being taken in its construction.

According to another object of the present invention, there is provided a metal skeleton for the reinforcement of a vertically elongated concrete structure, which metal skeleton is highly resistant to bending, or other deformation from its initial shape either during, or after, assembly.

According to another object of the present invention, there is provided a metal skeleton for the reinforcement of a vertically elongated concrete structure, which metal skeleton facilitates the even and consistent distribution of concrete therearound during pouring of the concrete.

According to another object of the present invention, there is provided a metal skeleton for the reinforcement of a vertically elongated concrete structure, wherein the significant expense and logistics problems in procuring all of the necessary materials and assembly equipment from various sources and shipping same, in a secure and timely manner, to a construction site are obviated.

According to another object of the present invention, there is provided a metal skeleton for the reinforcement of a vertically elongated concrete structure, which metal skeleton is readily reproducible as full scale test mules for stress and quality control evaluation and testing in controlled environments prior to similar skeletons being rolled out for widespread commercial use.

According to another object of the present invention, there is provided a metal skeleton for the reinforcement of a vertically elongated concrete structure, wherein the aforesaid problem of vertically aligning a pattern of threaded rods with a corresponding pattern of holes in the base plate, sole plate or sole plate or other mating component of a deck, verandah, floor, roof, pole, pillar, post, lintel, or other structure to be mounted atop the vertically elongated concrete structure is substantially overcome.

According to another object of the present invention, there is provided a metal skeleton for the reinforcement of a vertically elongated concrete structure, wherein it is unnecessary to use a supplemental bracing structure in forming either the metal skeleton or the vertically elongated concrete structure to ensure that the vertically elongated concrete structure remains vertically oriented thereby to provide for vertical orientation of any structure mounted atop the vertically elongated concrete structure.

According to another object of the present invention, there is provided a metal skeleton for the reinforcement of a vertically elongated concrete structure, wherein the metal skeleton can be manufactured according to very high pre-engineered standards of strength and durability and that is easily reproducible for pre-testing purposes, and for the purposes of mass-producing similar metal skeletons.

According to another object of the present invention, there is provided a metal skeleton for the reinforcement of a vertically elongated concrete structure, which metal skeleton can be assembled with greater speed and accuracy than prior art reinforcement skeletons suitable for forming such vertically elongated concrete structures.

There is thus disclosed according to one embodiment of the present invention a novel metal skeleton for the reinforcement of a vertically elongated concrete structure to be formed therearound. The metal skeleton has a vertical axis and comprises a first plurality of leg members each having a top end and a bottom end, an inner side edge and an outer side edge together defining a leg body portion. A first plurality of rib plate engagement slots are formed in at least one of the inner side edge and the outer side edge. Each of the leg members is formed from a substantially flat sheet of metal material. A first plurality of rib plates each define a generally planar central body portion and each have a first plurality of leg-engagement slots projecting into the central body portion. The leg-engagement slots are dimensioned and otherwise adapted to frictionally engage with respective ones of the rib plate engagement slots. The first plurality of leg-engagement slots slidingly interfit within respective ones of the first plurality of rib-engagement slots to securely connect the rib plates to the leg members to form the metal skeleton.

The above and other aspects, objects, advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which several embodiments of the invention will now be illustrated by way of example, only. It is expressly understood, however, that the drawings are for the purpose of illustration and description only, and are not intended as a definition of the limits of the invention. In the accompanying drawings.

PARTS LIST

Figure 1:
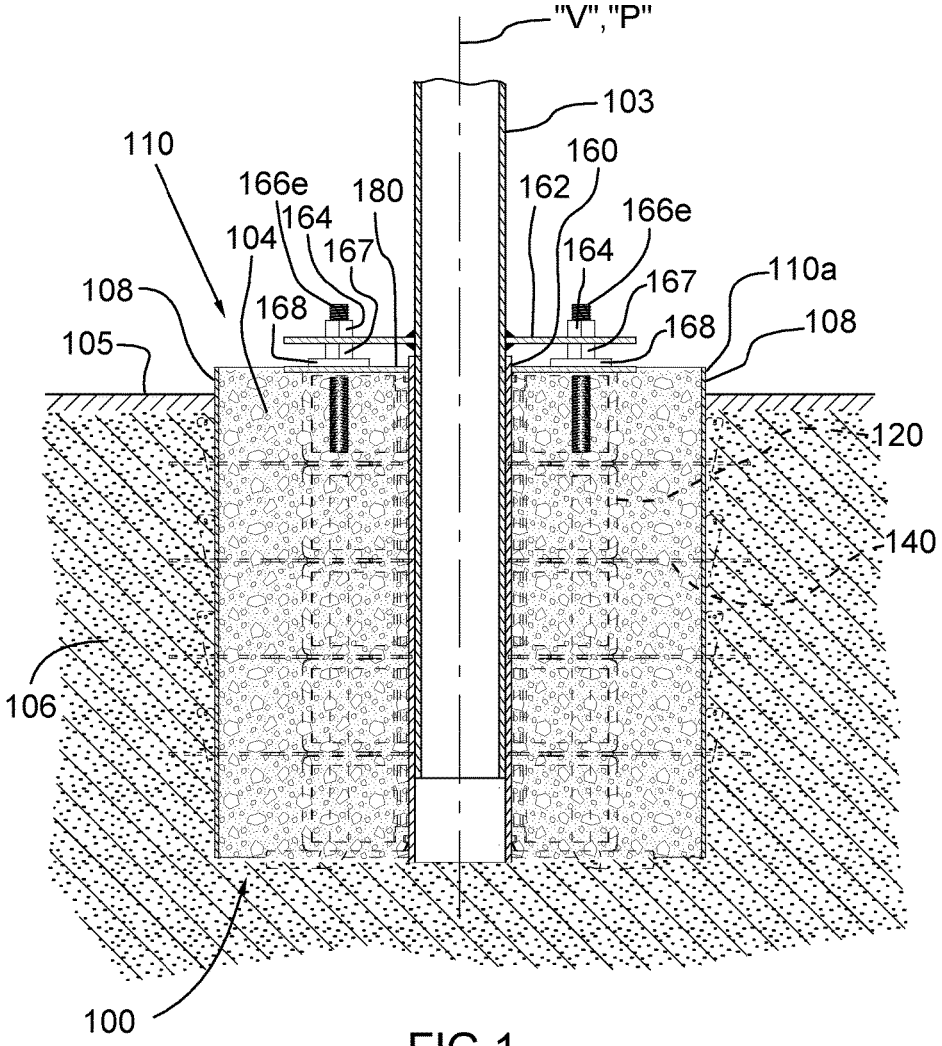
FIG. 1 is a sectional side elevational view of a first illustrated embodiment of metal skeleton according to the present invention embedded within a vertically elongated concrete structure supporting a pole.
Figure 2:
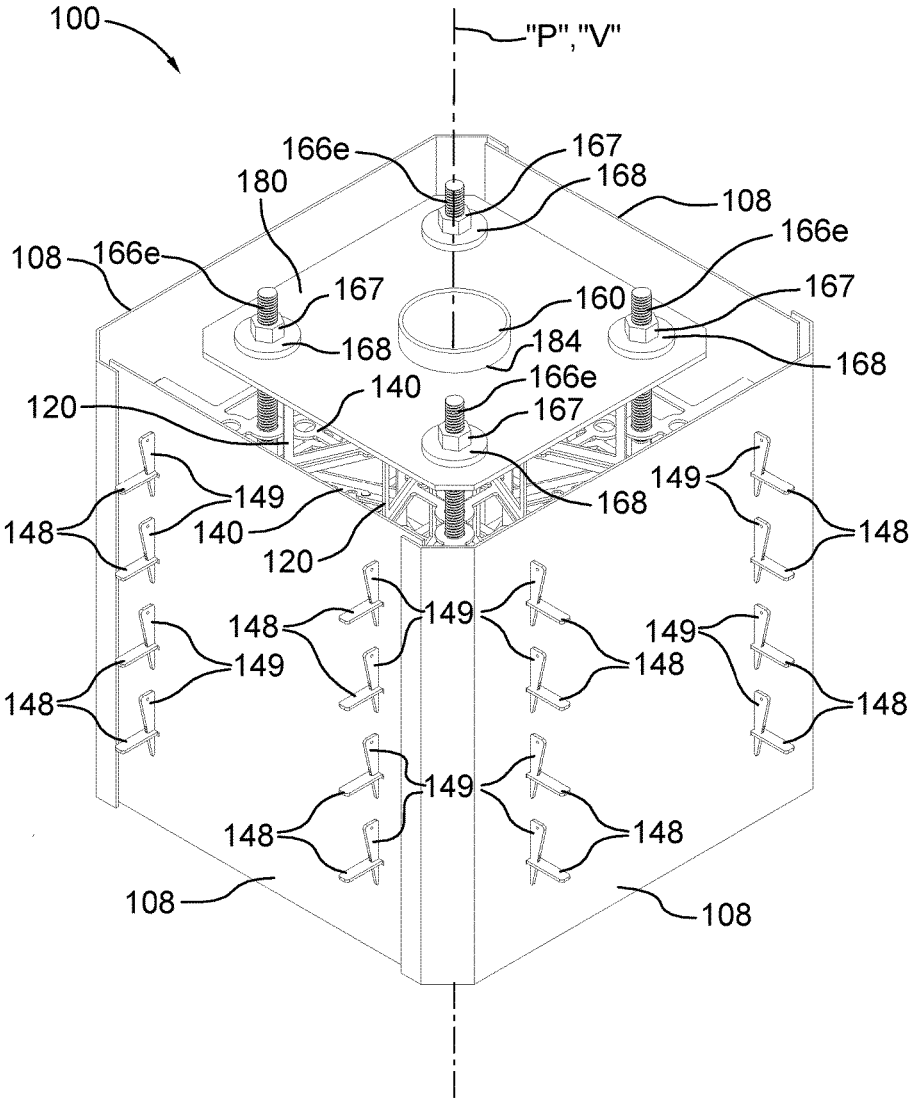
FIG. 2 is a perspective view, in isolation, of the first embodiment of metal skeleton illustrated in FIG. 1, with metal wall forms in place, before concrete is poured around the metal skeleton.
Figure 3:
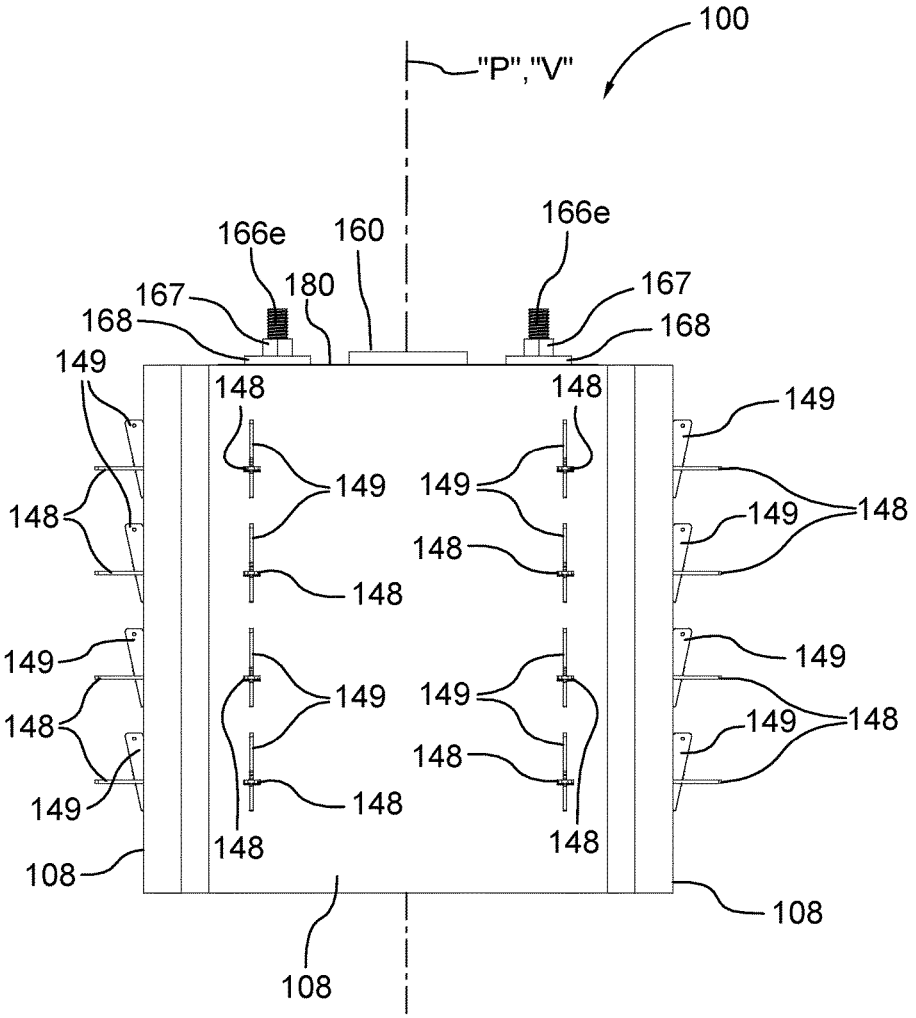
FIG. 3 is a side elevational view of the first embodiment illustrated in FIG. 2, with metal wall forms in place, before concrete is poured around the metal skeleton.

100 metal skeleton
103 mounted post
104 concrete
105 ground level (at construction site)
106 ground
108 concrete pouring forms
109 apertures
110 vertically elongated concrete structure
110*a* top portion of vertically elongated concrete structure
120 leg members
120*a* top end
120*b* bottom end
120*c* inner side edge
120*d* outer side edge
120*e* upper notch
120*f* lower notch
"L" longitudinal axis of leg members 120
121 first face
122 second face
124 leg body portion
126 openings
"TL" thickness
"WL" width
130 rib plate engagement slots
140 rib plates
140*a* inner peripheral edge
140*b* outer peripheral edge
140*c* post-receiving aperture
"D" diameter of the post-receiving aperture 140*c*
141 openings
142 generally planar central body portion
144 bolt-receiving apertures
148 outwardly projecting weight-bearing tabs
148*a* wedge-receiving aperture
148*e* narrower width end portion
148*r* remainder of 148
148*s* stop surface
148*t* shoulder
149 securing wedge
150 leg-engagement slots
160 base pipe
"P" longitudinal axis of central base pipe 160
162 base plate
164 uppermost threaded fasteners
166 "J"-bolts
166*e* straight threaded end portions
167 lowermost threaded fasteners
168 washers
170 flat sheet of metal material
172 formed sheets of metal material
180 top plate
182 bolt-receiving apertures

184 post-receiving aperture
190*a* upper split-ring clip
190*b* lower split-ring clip
200 metal skeleton
220 leg members
220*a* top end
220*b* bottom end
220*c* inner side edge
220*d* outer side edge
"L" longitudinal axis of leg members 220
221 first face
222 second face
224 leg body portion
226 openings
"TL" thickness
"WL" width
230 rib plate engagement slots
240 rib plates
240*a* inner peripheral edge
240*b* outer perimeter edge
240*c* post-receiving aperture
"D" diameter of the post-receiving aperture 240*c*
241 openings
242 generally planar central body portion
244 bolt-receiving apertures
250 leg-engagement slots
258 bumper members
266 "J"-bolts
266*e* straight threaded ends
267 threaded fasteners
268 washers
280 top plate
290*a* upper split-ring clip
290*b* lower split-ring clip

DETAILED DESCRIPTION OF THE ILLUSTRATED EMBODIMENTS

Referring to FIGS. 1 through 26 of the drawings, it will be noted that FIGS. 1 through 22 relate to a first illustrated embodiment of a metal skeleton according to the present invention, and FIGS. 23 through 26 relate to a second illustrated embodiment of ametal skeleton according to the present invention.

Reference will now be made to FIGS. 1 through 22, which depict the first illustrated embodiment of a metal skeleton according to the present invention, as indicated by the general reference numeral 100. The first illustrated embodiment of metal skeleton 100 is for reinforcement of a vertically elongated concrete structure, which structure is a concrete base indicated by the general reference numeral 110. The vertically elongated concrete structure 110 is integrally formed around the metal skeleton 100, with the metal skeleton 100 being substantially embedded within the cured concrete 104. The vertically elongated concrete structure 110 may be used to support, for example, a deck, a verandah, a floor, a pole, a pillar, a post, a roof, a lintel, a pylon, a bollard, a monument, or any other structure thereon. In the first illustrated embodiment, the vertically elongated concrete structure 110 is shown supporting a mounted metal post 103 of indeterminate length, which mounted post 103 may be attached atop the vertically elongated concrete structure 110 by modalities other than as shown in the Figures, with such modalities not being in any way essential to the primary inventive concept as claimed herein. As illustrated, the mounted post 103 may continue above the level illustrated to become, to be attached to, or to be integrated into, by any conventional means, a pole, a pillar, a post, a lintel, a pylon, a bollard, a deck, a verandah, a monument, or any other structure so as to support same and fix same in place atop the vertically elongated concrete structure 110. Alternatively, all of such structures may rest upon, be supported by, and be fixed in place atop the vertically elongated concrete structure 110 by gravity alone (as, for example, where the elongated concrete structure is a pillar or post extending substantially above ground level to support a deck, a floor, or a roof structure), or by any other operative means other than as shown and without the intervention of a mounted post 103, it being expressly understood that the inclusion of such a mounted post 103 is entirely optional, but may be convenient and advantageous in many applications.

The vertically elongated concrete structure 110 may be partially, or fully, buried in the ground 106, or may be fully supported atop the ground 106, depending upon the desired application. As shown in FIG. 1, it is buried in the ground 106 with only its top portion 110*a* being visible above ground level.

In the first embodiment illustrated, the metal skeleton 100 optionally, but not essentially, provides its own metal concrete pouring forms 108 that may be left attached to the vertically elongated concrete structure 110 after the concrete used to form same has cured. If left attached, these metal pouring forms 108 not only add smooth finished outer side surfaces to the vertically elongated concrete structure 110, but impart additional strength and durability thereto.

The provision and use of metal concrete pouring forms 108 is entirely optional, and it is fully envisioned that a metal skeleton 100 according to the invention may be used to form a vertically elongated concrete structure without the benefit of metal pouring forms, by, for example, placement of same in a hole in the ground 106, with the sidewalls of such hole acting as a pouring form to contain the concrete poured in place around the metal skeleton 100 during the construction of the vertically elongated concrete structure 110. Alternatively, at least some embodiments disclosed herein, including the embodiment illustrated in FIGS. 22 through 26, are ideally suited for use by placement within a non-metal casting form, such as a cylindrically shaped non-metal Sonotube™ casting form, prior to pouring and curing of concrete therearound.

Figure 6:
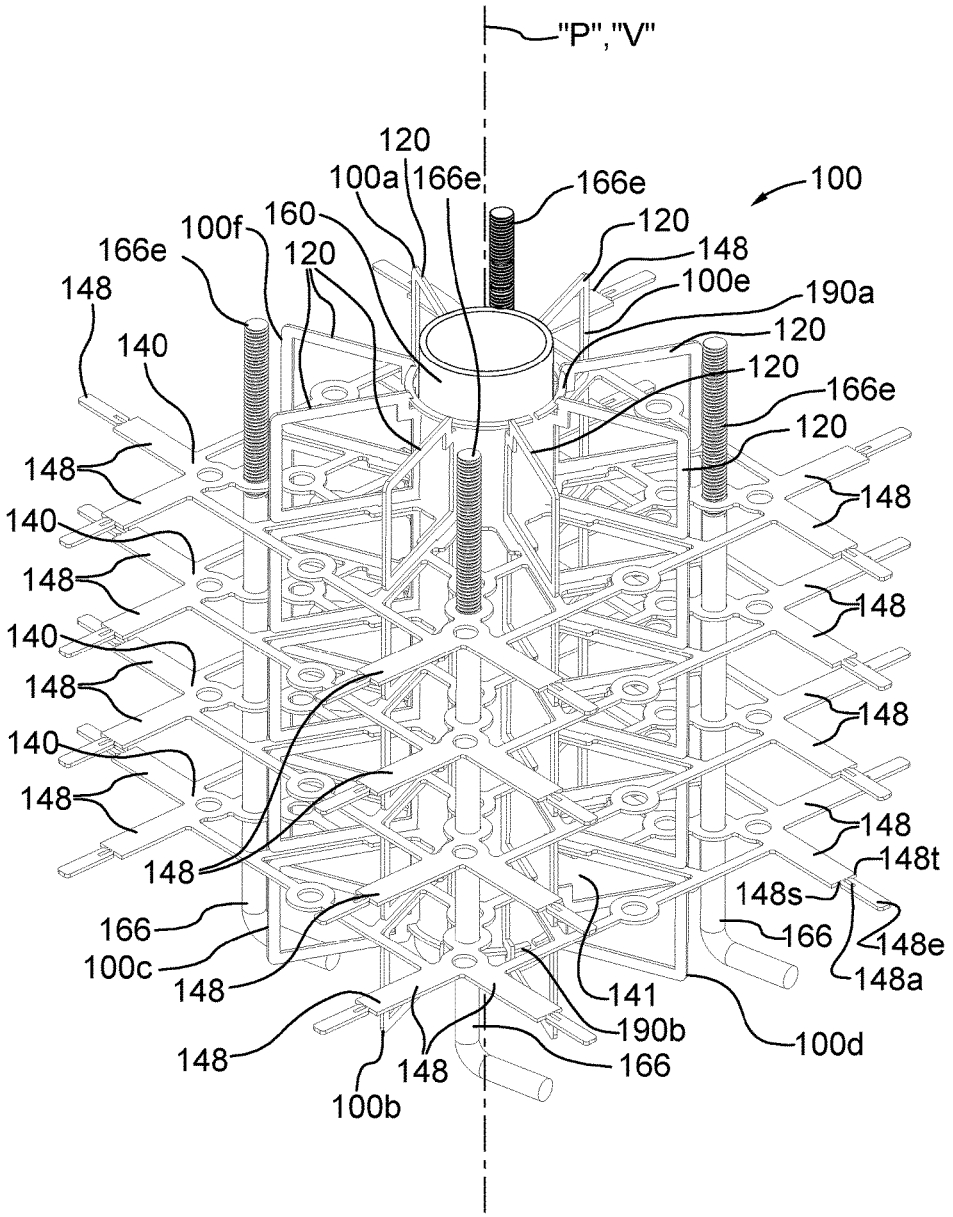
FIG. 6 is a perspective view, in isolation, of the first embodiment of metal skeleton illustrated in FIGS. 2 to 5.
Figure 7:
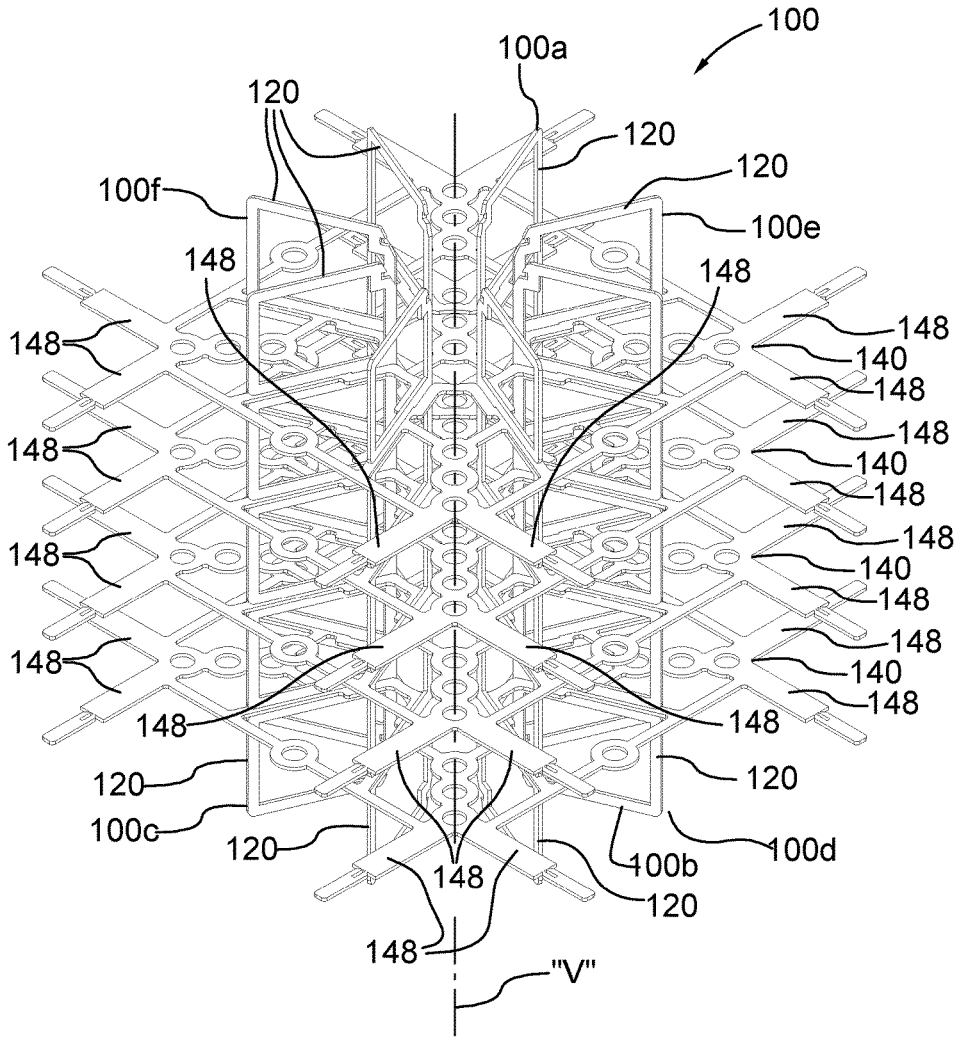
FIG. 7 is a perspective view similar to FIG. 6, but with the optional "J"-bolts and the center post removed.

As best seen in FIGS. 6 and 7, the first illustrated embodiment metal skeleton 100 has a generally centrally disposed vertical axis "V". It should be understood that the term "vertical" has been chosen for the sake of convenience and clarity of explanation and is not necessarily absolute. For instance, the vertically elongated concrete structure 110 as shown is generally vertically oriented in all views. Alternatively, the same structure, an analogous structure, or a similar structure, could, in use, be oriented away from vertical, or could even be oriented horizontally for other purposes.

In overview, the first illustrated embodiment metal skeleton 100 comprises a first plurality of leg members 120 having a first plurality of rib plate engagement slots 130, a first plurality of rib plates 140 each having a first plurality of leg-engagement slots 150, an optional base pipe 160, four optional "J"-bolts 166, an optional top plate 180, and two optional split-ring clips 190*a*, 190*b*.

More particularly, in the first illustrated embodiment of metal skeleton 100, the first plurality of leg members 120 preferably, but not essentially, comprises eight leg members 120. It is contemplated that the first plurality of leg members 120 could readily comprise from three leg members 120 to eight leg members 120, inclusive, or even more than eight leg members, depending upon the intended application. The first plurality of leg members 120 may preferably be disposed in substantially equally radially spaced relation around the vertical axis "V" of the metal skeleton 100.

Each of the leg members 120 defines a longitudinal axis "L" that, in the first illustrated embodiment, is generally vertically disposed and is, therefore, also substantially parallel to the generally centrally disposed vertical axis "V" of the metal skeleton 100. Further, each of the leg members 120 has a top end 120*a*, a bottom end 120*b*, an inner side edge 120*c* and an outer side edge 120*d* that together define a leg body portion 124.

Each of the first plurality of leg members 120 has a first plurality of rib plate engagement slots 130 formed in at least one of the inner side edge 120*c* and the outer side edge 120*d*. In the first illustrated embodiment of metal skeleton 100, there are four parallel rib plate engagement slots 130 spaced vertically evenly one from the next formed as inwardly directed indentations the outer side edge 120*d* of each of the eight leg members 120, which engagement slots 130 run inwardly from the outer side edge 120*d* in generally transverse relation to the respective longitudinal axis "L".

The first plurality of leg members 120 preferably each have opposed flat faces, namely a first face 121 and a second face 122. Further, the first plurality of leg members 120 each preferably have a thickness "TL" defined between the first 121 and second 122 opposed faces, and a width "WL" defined between the inner side edge 120*c* and the outer side edge 120*d* thereof. The width "WL" is preferably between twenty to one hundred times greater than the thickness "TL". The width "WL" and the thickness "TL" of the leg members 120 should be chosen depending on the specific type of metal used to form the leg members 120 and the required load bearing capabilities, among other factors. It should also be understood that the width "WL" and the thickness "TL" of some of the leg members 120 might be different than the width "WL" and the thickness "TL" of others of the leg members 120.

Figure 8:
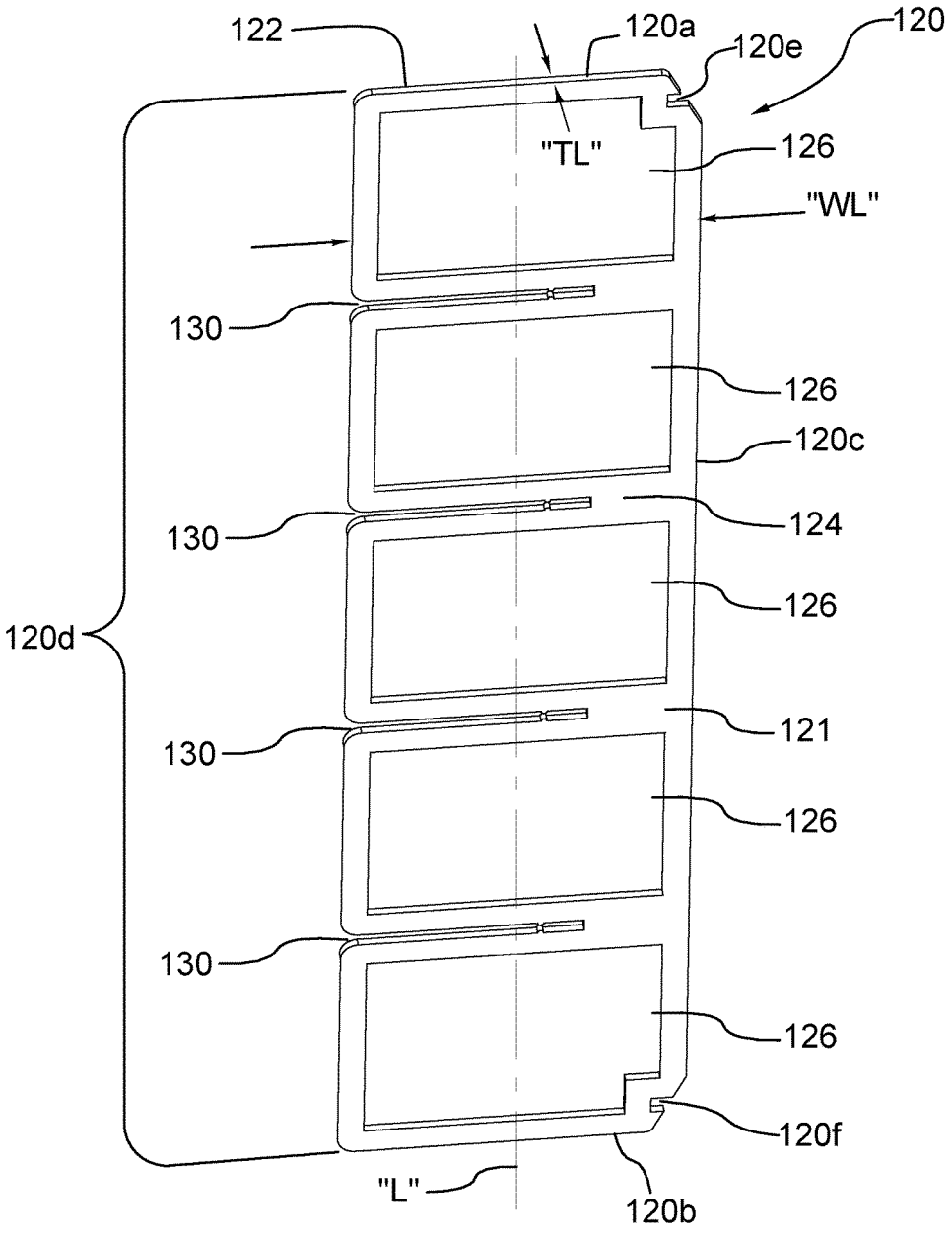
FIG. 8 is a side perspective view, in isolation, of one of the leg members used in the first illustrated embodiment of FIGS. 1 through 7.
Figure 9:
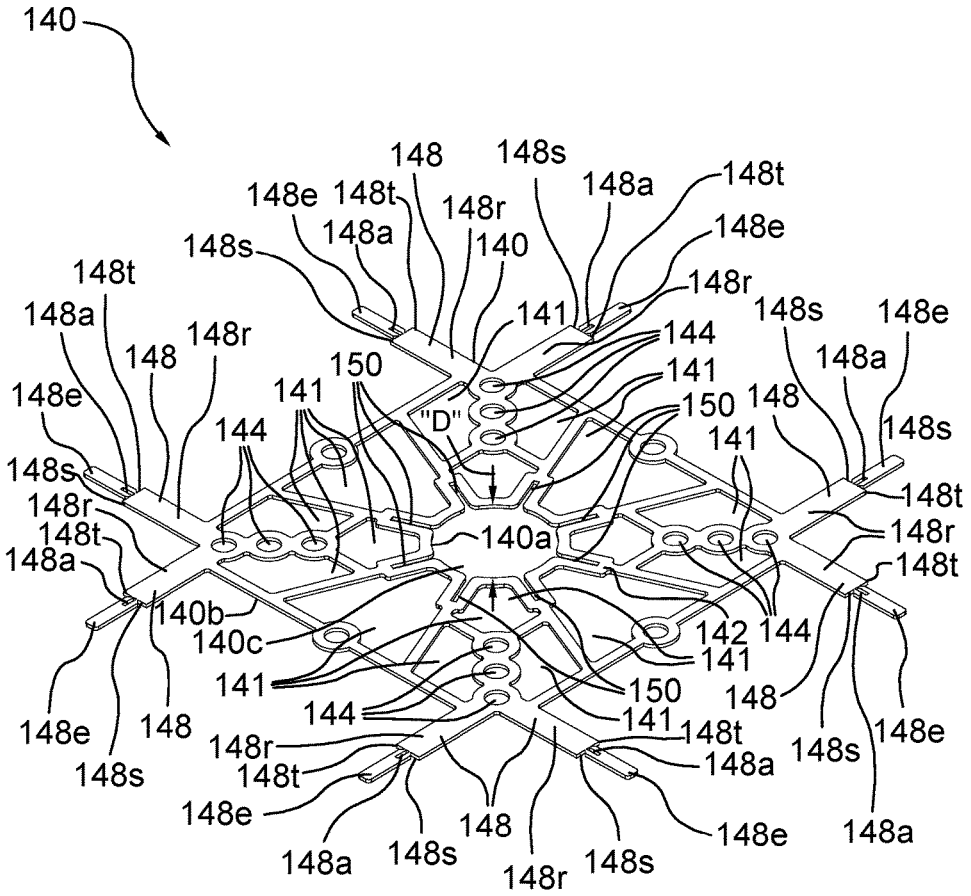
FIG. 9 is a perspective view, in isolation, of a rib plate used in the first illustrated embodiment of FIGS. 1 through 7.

Further, the first plurality of leg members 120 each preferably have a plurality of openings 126, specifically five openings 126 as seen in FIG. 8, disposed in the first plurality of leg members 120 between adjacent ones of the rib plate engagement slots 130. The openings are formed in the leg members 120 to, inter alia, facilitate the flow of uncured concrete around the first plurality of leg members 120 during formation of the vertically elongated concrete structure member 110. As can readily be seen in FIG. 8, the overall cumulative area of the five openings 126 constitutes a substantial portion of the overall area of each of the leg members 120 to help maximize the flow of uncured concrete around and through the first plurality of leg members 120. The plurality of openings 126 also serve to reduce the weight of the leg members 120, which weight reduction can be advantageous for component shipping and handling purposes.

As can be readily seen, in the first illustrated embodiment of metal skeleton 100, the first plurality of rib plates 140 specifically comprises four rib plates 140. It is contemplated that the first plurality of rib plates 140 could readily comprise from two to perhaps a dozen or more rib plates 140, inclusive, depending upon the vertical height and rigidity required of the desired metal skeleton 100 in any particular application.

The first plurality of rib plates 140 each have an inner peripheral edge 140*a* and an outer peripheral edge 140*b*. The inner peripheral edge 140*a* and the outer peripheral edge 140*b* together define a generally planar central body portion 142 of each of the first plurality of rib plates 140. The central body portion 142 of each rib plate 140 is, when the metal skeleton 100 is assembled, oriented substantially transversely to the vertical axis "V" of the metal skeleton 100. Also, the rib plates 140 are each preferably, but not essentially, positioned within the metal skeleton 100 with their respective central body portions 142 substantially equidistant one from the next. Further, when the rib plates 140 are securely connected to the leg members 120, each longitudinal axis "L" is oriented substantially transversely to the central body portions 142 of each of the rib plates 140.

The inner peripheral edge 140*a* of each rib plate 140 preferably, but not essentially, defines a post-receiving aperture 140*c* positioned within the central body portion 142 of each rib plate 140. Preferably, but not essentially, the post-receiving apertures 140*c* in the first plurality of rib plates 140 are each substantially circular in plan outline and are substantially each the same size as the others. Alternatively, it is contemplated that each of the post-receiving apertures could be substantially square in plan outline. Other geometric shapes for the post-receiving apertures are equally possible. Once the metal skeleton 100 is assembled, the post-receiving apertures 140*c* of the first plurality of rib plates 140 are in substantial central alignment one with the other within the central body portion 142 of each rib plate 140.

Further, the first plurality of rib plates 140 each have a first plurality of leg-engagement slots 150 that project from the inner peripheral edge 140*a* into the central body portion 142. The leg-engagement slots 150 are dimensioned and otherwise adapted to frictionally engage with respective ones of the rib plate engagement slots 130 formed in the leg members 120. More particularly, the first plurality of leg-engagement slots 150 slidingly interfit within respective ones of the first plurality of rib-engagement slots 130 to securely connect the rib plates 140 to the leg members 120, so as to form the metal skeleton 100.

Figure 10:
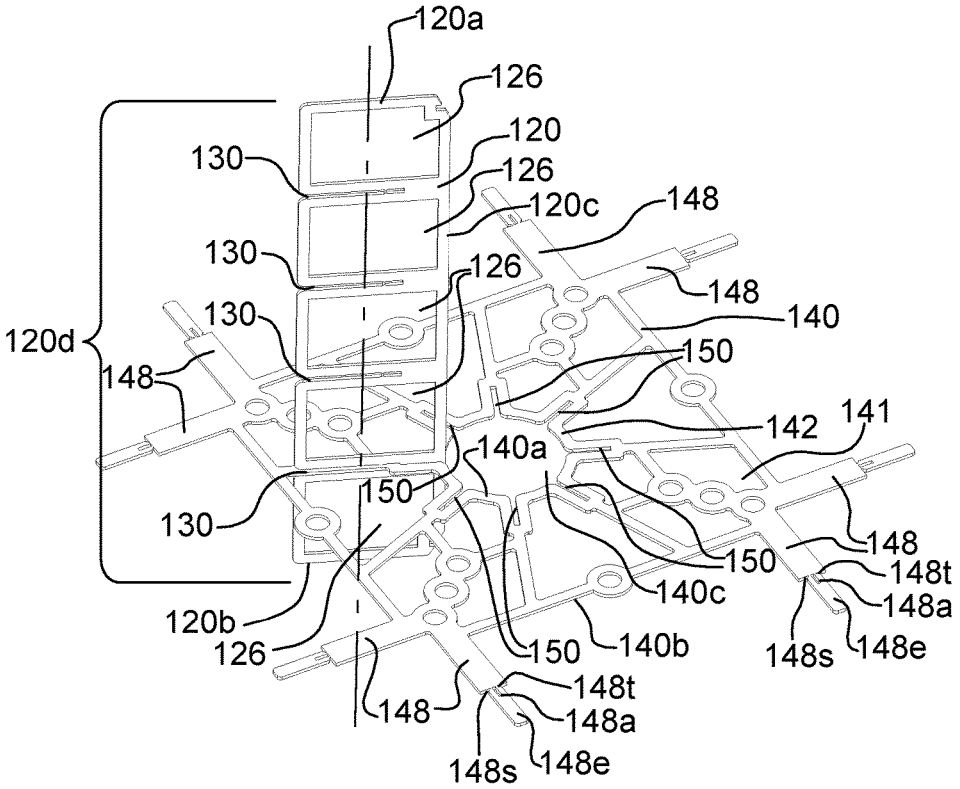
FIG. 10 is a perspective view, in isolation, of the leg member of FIG. 8 and the rib plate of FIG. 9, slidably connected one to the other.

As perhaps best appreciated from reviewing FIG. 10, in the first illustrated embodiment, the width "WL" of the leg members 120 needs to be less than the cumulative span of the post-receiving aperture 140*c* and two opposed leg-engagement slots 150 in order to slide the leg members 120 one at a time into position such that the one of the rib plate engagement slots 130 of the leg member 120 engages a co-operating one of the leg-engagement slots 150 of the rib plate 140 during initial assembly of the metal skeleton 100 from its main components, namely the first plurality of leg members 120 and the first plurality of rib plates 140.

In a similar manner to the leg members 120, the first plurality of rib plates 140 each preferably has a plurality of opening spaces 141 formed within the central body portion 142 of each rib plate 140 to facilitate the flow of uncured concrete around the first plurality of rib plates 140. As can readily be seen in FIGS. 6, 7 and 9-20, the overall cumulative area of the openings 141 constitutes a substantial portion of the overall area of each of the rib plates 140 to help maximize the flow of uncured concrete around and through the first plurality of rib plates 140. The plurality of openings 141 also serve to reduce the weight of the rib plates 140, which weight reduction can be advantageous for shipping and handling purposes.

Figure 21:
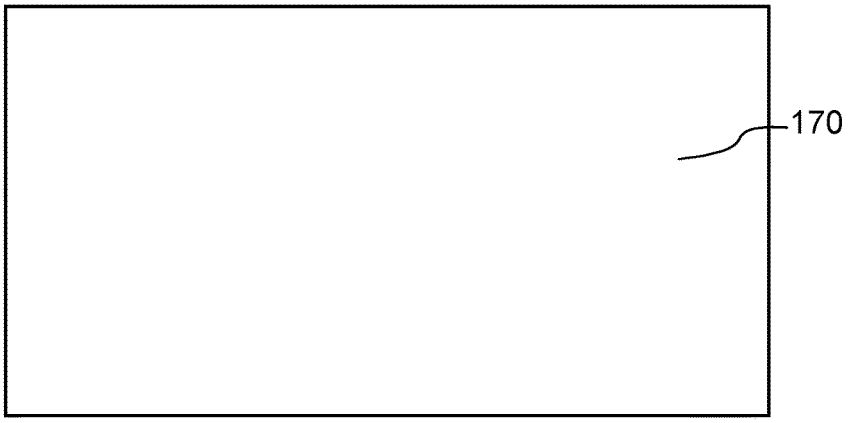
FIG. 21 is a top plan view of a substantially flat sheet of metal material used to form therein components of the first illustrated embodiment of the metal skeleton.
Figure 22:
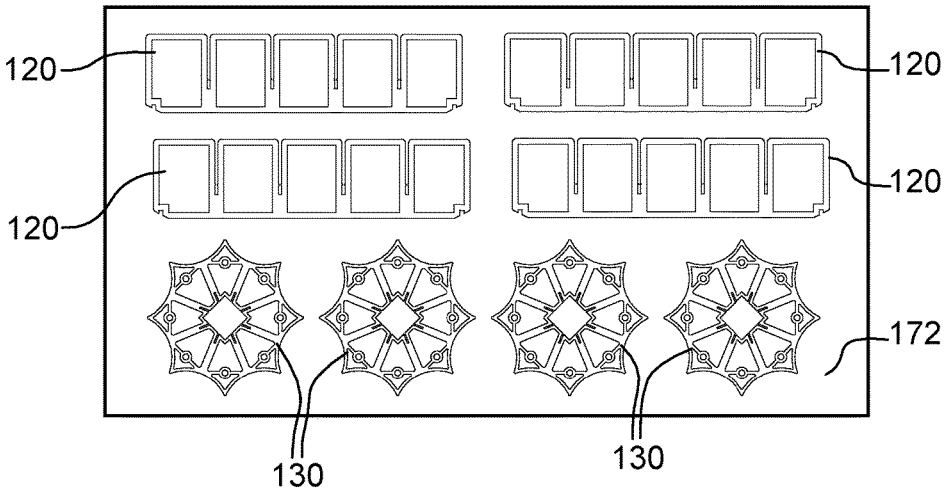
FIG. 22 is a top plan view of the substantially flat sheet of metal material of FIG. 21, but with leg members and rib plates formed therein by laser cutting, thereby producing a substantially flat formed sheet of metal material.

One of the advantages of the present invention is that its components, such as the first plurality of leg members 120, the first plurality of rib plates 140, the top plate 180, and the split-ring clips 190, can all be fabricated from one or more substantially flat sheets of metal material 170, as can best be seen in FIG. 21. Once the substantially flat sheets of metal material 170 have had the aforementioned components formed therein, they become formed sheets of metal material 172, as can best be seen in FIG. 22. The flat nature of the components facilities and cuts not only the cost of production, but also the costs of shipping and storing such components, as they may, unlike conventional bulk rebar material, be conveniently and economically shipped and stored in flat-packed packages and containers.

The substantially flat sheets of metal material 170 typically may be made from mild steel sheet or plate, stainless steel sheet or plate, aluminum sheet or plate, copper or brass sheet or plate, and would typically have a relatively thin gauge (e.g. about 0.1 mm to 19.0 mm), but can be made from any other suitable metal material appropriate for the intended application. Accordingly, the metal skeleton 100 may be relatively inexpensive to manufacture and requires only simple manually operable tools (e.g., a hammer) to assemble together. Further, it is relatively easy to cut, or otherwise remove, the components of the metal skeleton 100 from the substantially flat formed sheets of metal material 172 and to handle them after such removal.

Figure 20:
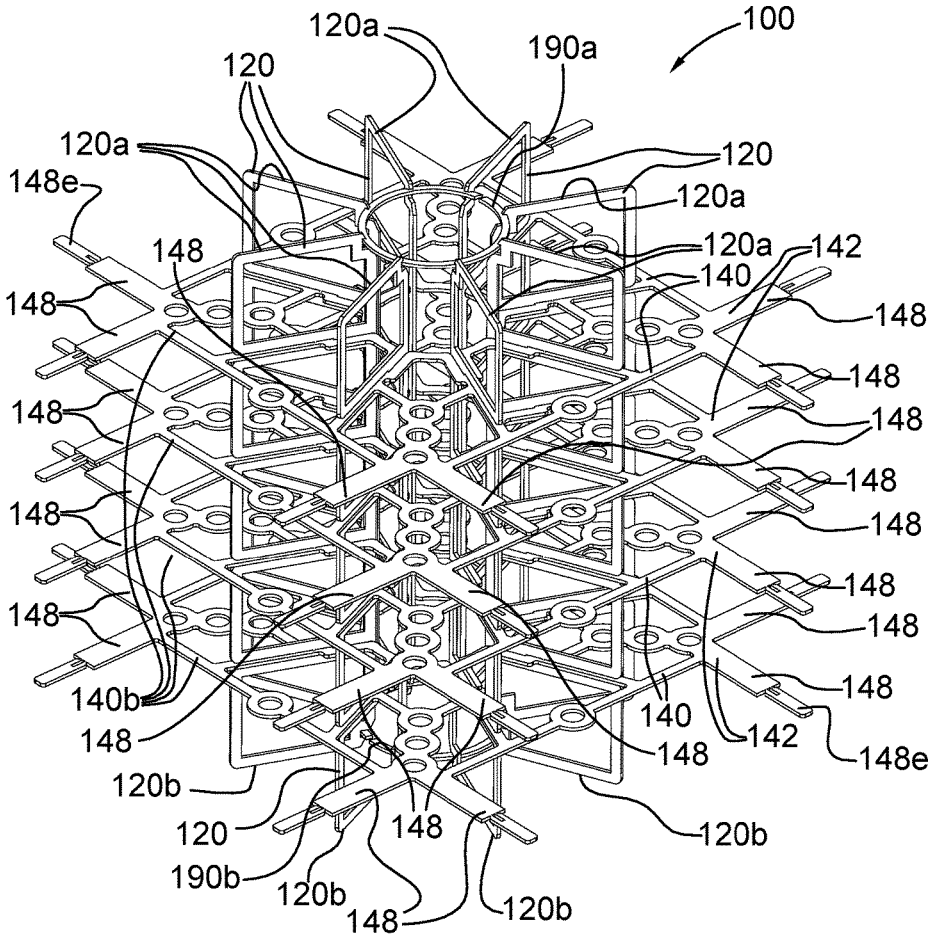
FIG. 20 is a perspective view similar to FIG. 19, with an eighth leg member also slidably connected in seriatim to the four rib plates of FIG. 19, and with an upper and a lower split-ring clip in place to assist in retaining the four leg members securely in place relative to each other.

In the substantially assembled configuration of the metal skeleton 100 shown in FIG. 20, each of the first plurality of leg-engagement slots 150 is disposed in vertically aligned relation with another one of the first plurality of leg-engagement slots 150 in each of the vertically adjacent ones of the first plurality of rib plates 140. Also, the post-receiving apertures 140*c* of the first plurality of rib plates 140 are substantially vertically aligned each with the others.

As previously mentioned, the metal skeleton 100 may further optionally comprise a hollow base pipe 160 of complimentary cross-section to the shape of the post-receiving aperture 140*c*. In the first illustrated embodiment, the base pipe 160 is shown as circular in cross-section. Any other suitable shape of cross-section may be employed. As can readily be seen in FIGS. 2 and 4 through 6 the base pipe 160 is disposed within one or more, and preferably within all four, of the post-receiving apertures 140*c* respectively formed in each rib plate 140.

Once the metal skeleton 100 is in the substantially fully assembled configuration illustrated in FIG. 20, the base pipe 160 may be positioned in place within the substantially vertically aligned post-receiving apertures 140*c* of the first plurality of rib plates 140. As may best seen in FIGS. 1-6 and 20, once the base pipe 160 is so disposed in snug-fitting relation within the one or more post-receiving apertures 140*c*, the longitudinal axis "P" of the base pipe 160 is held in this configuration in substantially aligned relation with the vertical axis "V" of the metal skeleton 100, thereby preventing it from being skewed to any significant degree from vertical.

The first illustrated embodiment of metal skeleton 100 additionally, but optionally, may comprise two or more split-ring clips, more specifically being an upper split-ring clip 190*a* and a lower split-ring clip 190*b*. The upper split-ring clip 190*a* engages an upper notch 120*e* formed in the inner side edge 120*c* of each of the leg members 120. Similarly, the lower split-ring clip 190*b* engages a lower notch 120*f* formed in the inner side edge 120*c* of each of the leg members 120. The upper split-ring clip 190*a* and the lower split-ring clip 190*b* engage the leg members 120 by the notches 120*e* and 120*f* as aforesaid in an outwardly biasing manner to thereby restrict movement of each of the leg members 120 in an inwardly direction parallel to the plane of the central body portion 142 of the rib plates 140. Such restriction is essentially complete once the base pipe 160 is disposed in said snug-fitting relation within the one or more post-receiving apertures 140*c*, as described above. Accordingly, the upper split-ring clip 190*a* and the lower split-ring clip 190*b* are best installed into the metal skeleton 100 prior to the base pipe 160 being inserted into the post-receiving apertures 140*c*.

Figure 4:
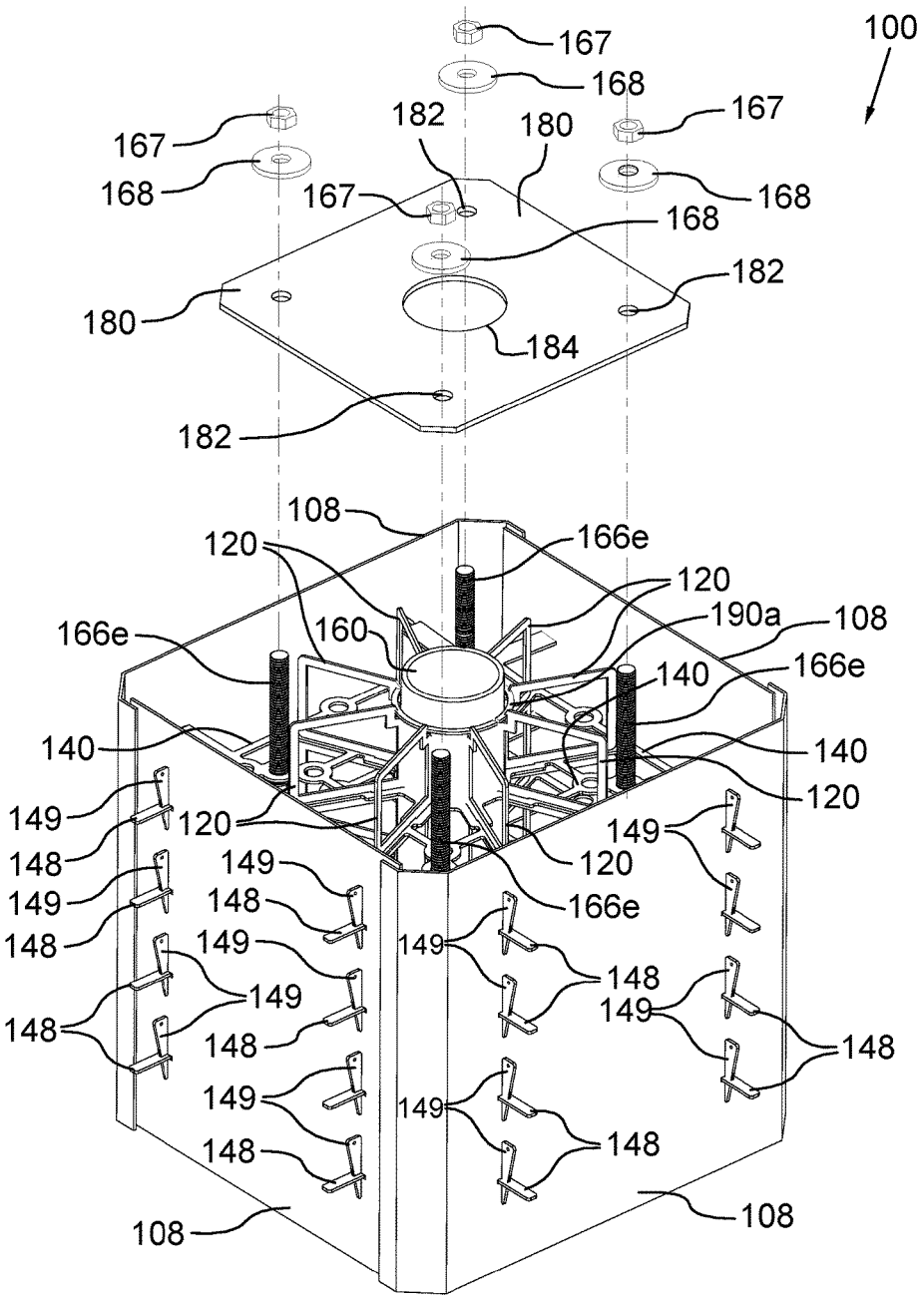
FIG. 4 is a view similar to FIG. 2, but with a top plate and fastening means shown vertically separated from the remainder of the first embodiment of metal skeleton.
Figure 5:
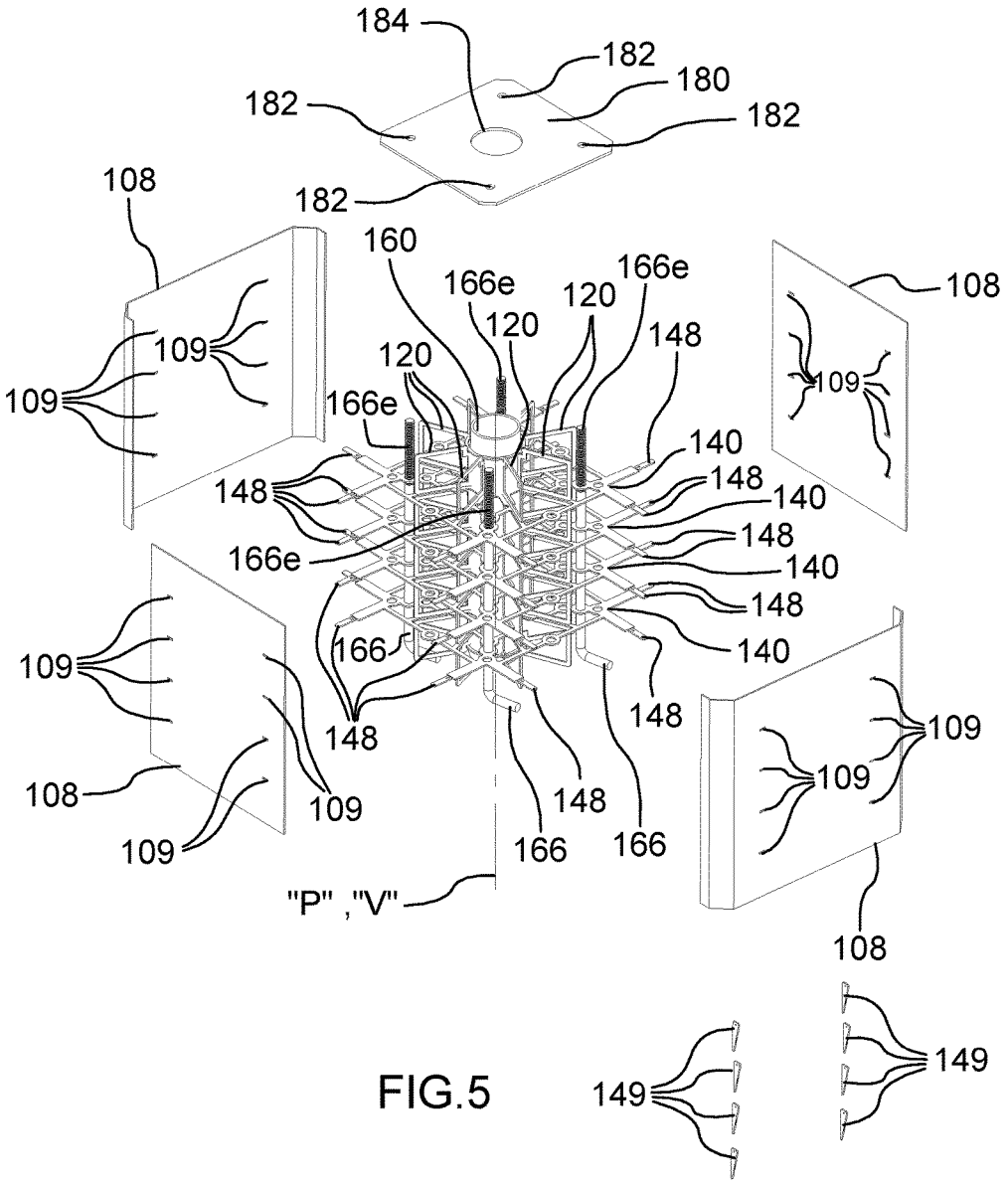
FIG. 5 is a reduced scale view similar to FIG. 4, but additionally showing all of the metal wall forms horizontally separated from the first embodiment of the invention to better illustrate the metal skeleton within.

As best seen in FIGS. 4, 5 and 6, each of the rib plates 140 may have a plurality of vertically aligned bolt-receiving apertures 144 formed therein. In the first illustrated embodiment, the plurality of bolt-receiving apertures 144 preferably, but not essentially, comprises four bolt-receiving apertures 144 arranged between the post-receiving apertures 140*c* and the outer peripheral edge 140*b* in a square pattern. The assembled metal skeleton 100 further preferably, but not essentially, comprises an equal plurality of optional "J"-bolts 166 having their straight threaded end portions 166*e* extending vertically upwardly through the bolt-receiving apertures 144 beyond the top ends 120*a* of the first plurality of leg members 120. In this manner, the optional "J"-bolts will become firmly anchored in the concrete 106 that cures around the metal skeleton 100 with their threaded ends 166*e* in substantially parallel vertical alignment with the vertical axis "V".

The assembled metal skeleton 100 further optionally, but not essentially, comprises a top plate 180 resting upon the top ends 120*a* of the first plurality of leg members 120. The top plate 180 has a plurality of bolt-receiving apertures 182 formed therein, specifically four bolt-receiving apertures 182 in the first illustrated embodiment of metal skeleton 100. The number of bolt-receiving apertures 182 should be an equal plurality to the number of "J"-bolts 166 and the number of bolt-receiving apertures 144. Moreover, the bolt-receiving apertures 182 are each positioned and otherwise adapted to receive one of the straight threaded end portions 166*e* of the optional "J"-bolts 166 in respective through-passing relation, thereby to provide for securement of the top plate 180 to the metal skeleton 100 by means of lowermost threaded fasteners 167 and co-operating washers 168 engaging the straight threaded end portions 166*e* of the "J"-bolts 166 extending through the bolt-receiving apertures 182 formed in the top plate 180. The top plate 180 also features a generally centrally disposed post-receiving aperture 184 formed therein for allowing the base pipe 160 to pass therethrough.

Reference will now be made to FIG. 1 to briefly explain an installation and vertical alignment procedure for mounting the post 103 atop the vertically elongated concrete structure 110, which procedure typically takes place after pouring and curing of concrete 104 around the metal skeleton 100 has been completed. To commence installation of the mounted post 103, the lower end portion of the mounted post 103 is slidably inserted into the base pipe 160 until the base plate 162 (that is welded or otherwise affixed to the mounted post 103) rests in weight bearing relation on top of the lowermost threaded fasteners 167. The base plate 162 and the mounted post 103 are thereafter initially held in place by loose tightening of co-operating uppermost threaded fasteners 164 around the straight threaded end portions 166*e* of the optional "J"-bolts 166 above the base plate 162. Thereafter, fine alignment of the longitudinal axis "V" of the mounted post 103 to true vertical may be achieved by use of a level (not shown) held against the side of the mounted post 103 in conjunction with coordinated trial-and-error micro-adjustment of the four lowermost threaded fasteners 167 and the four uppermost threaded fasteners 164 about the threaded end portions 166*e* of the "J-bolts" 166. Once the mounted post 103 is determined to have its longitudinal axis "V" sufficiently aligned with true vertical, the threaded fasteners 164,168 may be carefully snugged up against the respective sides of the base plate 162 to a desired torque in order to securely hold the mounted post 103 in the desired orientation. In this manner, the mounted post 103 is retained securely in place atop the vertically elongated concrete structure 110 in vertical alignment sufficient for the intended purpose.

Each of the first plurality of rib plates 140 optionally, but not essentially, has one or more horizontally outwardly projecting weight-bearing tabs 148 adapted to retain the metal concrete pouring forms 108 in weight-supported relation on the weight-bearing tabs 148 during the forming of the vertically elongated concrete structure 110.

Each of the outwardly projecting weight-bearing tabs 148 has a narrower width end portion 148*e* and a shoulder 148*t* positioned between the narrower width end portion 148*e* and the remainder 148*r* of each outwardly projecting weight-bearing tab 148, which shoulder 148*t* defines at least one stop surface 148*s* against which the concrete pouring form bears against when in place. The narrower width end portion 148*e* of each outwardly projecting weight-bearing tab 148 has at least one wedge-receiving aperture 148*a* therein that receives a respective securing wedge 149 to hold the respective concrete pouring form 108 in place during pouring of uncured concrete within and around the metal skeleton 100 and during the curing of the concrete 104 the metal skeleton 100. Each of the securing wedges 149 may be removed from the at least one wedge-receiving aperture 148*a* subsequent to the curing of the concrete 104, or may be left in place if the concrete pouring forms 108 are to remain in place after curing.

As previously mentioned, the first illustrated embodiment metal skeleton 100 may optionally, but not essentially, further comprise a plurality of metal concrete pouring forms 108, as are best seen in FIGS. 1 through 5. The metal concrete pouring forms 108 each have at least one aperture 109 formed therein so as to be hangable on the outwardly projecting weight-bearing tabs 148.

It should be understood that the metal concrete pouring forms 108 are preferably made from a metal material such as mild steel, or stainless steel, but alternatively could be made from any other suitable material. The assembled portion of the metal skeleton 100 is shown in FIGS. 5 and 6 prior to the metal wall forms 150 being installed thereon. The metal wall forms 108 are installed on the metal skeleton 100 to thereby act as forms to encase the uncured concrete after it is poured into and around the metal skeleton 100 and within the hollow interior between the metal wall forms 108 to form the vertically elongated concrete structure 110.

Figure 11:
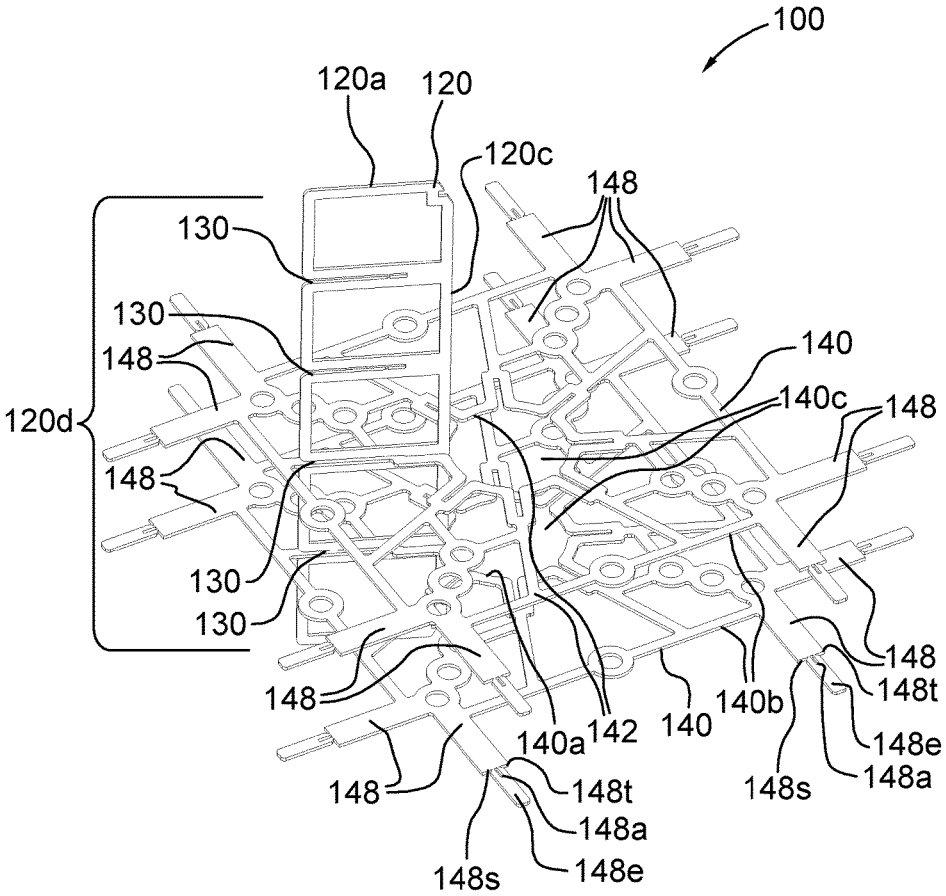
FIG. 11 is a perspective view similar to FIG. 10, but with a second rib plate also slidably connected in seriatim to the leg member of FIG. 8.

Assembly of the first embodiment of metal skeleton 100 will now be described with reference to FIGS. 11 through 20. As can be seen in FIG. 11, one of the rib plates 140 has been oriented and retained in a generally horizontal orientation, or at least close to a generally horizontal orientation, typically at least partially by human hands. Also, one of the leg members 120 has been retained in oriented and retained in a generally vertical orientation, or at least close to a generally horizontal orientation, typically at least partially by human hands. Further, the leg member 120 has been vertically slid into the post-receiving aperture 140*c* until the lowermost one of the rib plate engagement slots 130 of the leg member 120 is aligned with a selected one of the leg-engagement slots 150 of the rib plate 140. The leg-engagement slot 150 is thereafter slidingly interfit within the rib-engagement slot 130 to securely connect the rib plate 140 to the leg member 120 to start to form the metal skeleton 100. Alternatively, the leg member 120 may be oriented and retained in a generally vertical orientation, or at least close to a generally vertical orientation, typically at least partially by human hands, and then the rib plate 140 slid in place over the leg member 120 until the lowermost one of the rib plate engagement slots 130 of the leg member 120 is aligned with the selected one of the leg-engagement slots 150 of the rib plate 140, so the leg-engagement slot 150 can be slidingly interfit within the rib-engagement slot 130 to securely connect the rib plate 140 to the leg member 120 to start to form the metal skeleton 100. The end result is the same.

As can perhaps best be appreciated from a review of FIG. 10, the width "WL" of the leg members 120 needs to be less than the cumulative span of the post-receiving aperture 140*c* and one of the leg-engagement slots 150 in order to slide the leg members 120 one at a time into position such that the one of the rib plate engagement slots 130 of the leg member 120 engages a co-operating one of the leg-engagement slots 150 of the rib plate 140 during initial assembly of the metal skeleton 100 from its main components, namely the first plurality of leg members 120 and the first plurality of rib plates 140.

As can be seen in FIG. 11, a second one of the rib plates 140 has been oriented and retained in a generally horizontal orientation, or at least close to a generally horizontal orientation, and has been slid vertically into place such that the leg-engagement slot 150 of the rib plate 140 and one of the second-from-the-bottom rib plate engagement slot 130 of the leg member 120 are aligned one with the other. The leg-engagement slot 150 is then slidingly interfit within the rib-engagement slot 130 to securely connect the second rib plate 140 to the leg member 120 to continue to form the metal skeleton 100.

Figure 12:
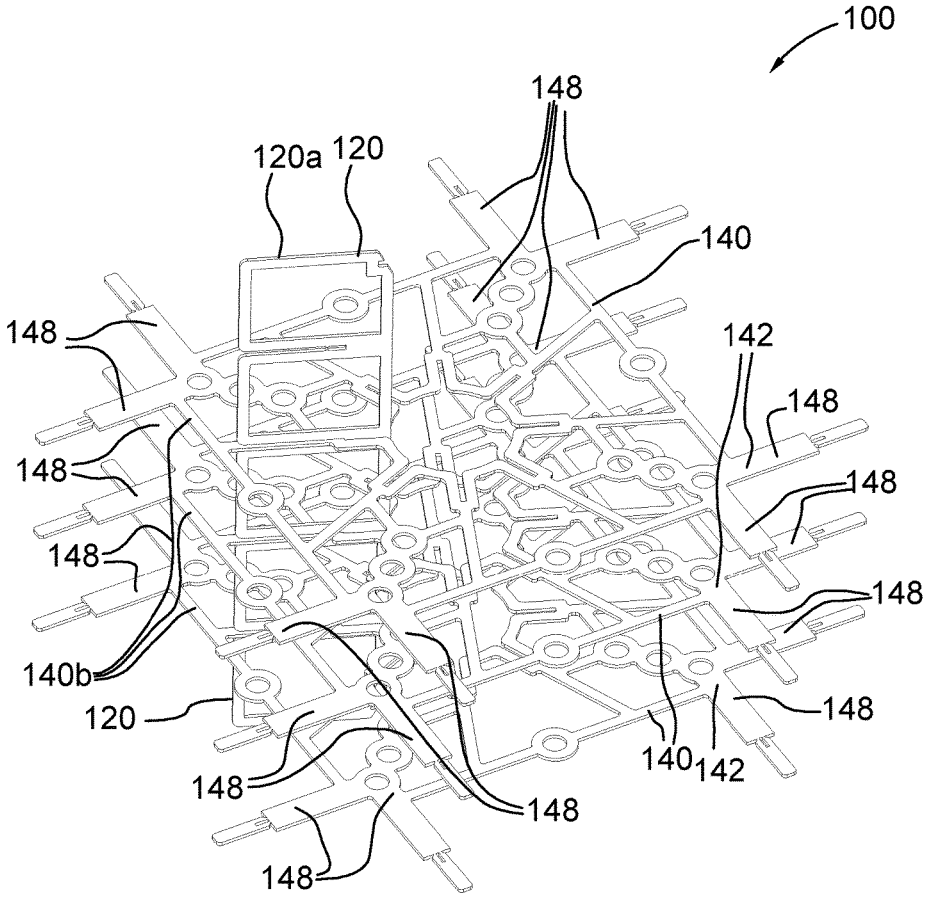
FIG. 12 is a perspective view similar to FIG. 11, but with a third rib plate also slidably connected in seriatim to the leg member of FIG. 8.

Similarly, as can be seen in FIG. 12, a third one of the rib plates 140 has been slid vertically into place such that the leg-engagement slot 150 of the rib plate 140 and one of the second-from-the-top rib plate engagement slot 130 of the leg member 120 are aligned one with the other. The leg-engagement slot 150 is then slidingly interfit within the rib-engagement slot 130 to securely connect the second rib plate 140 to the leg member 120 to continue to form the metal skeleton 100.

Figure 13:
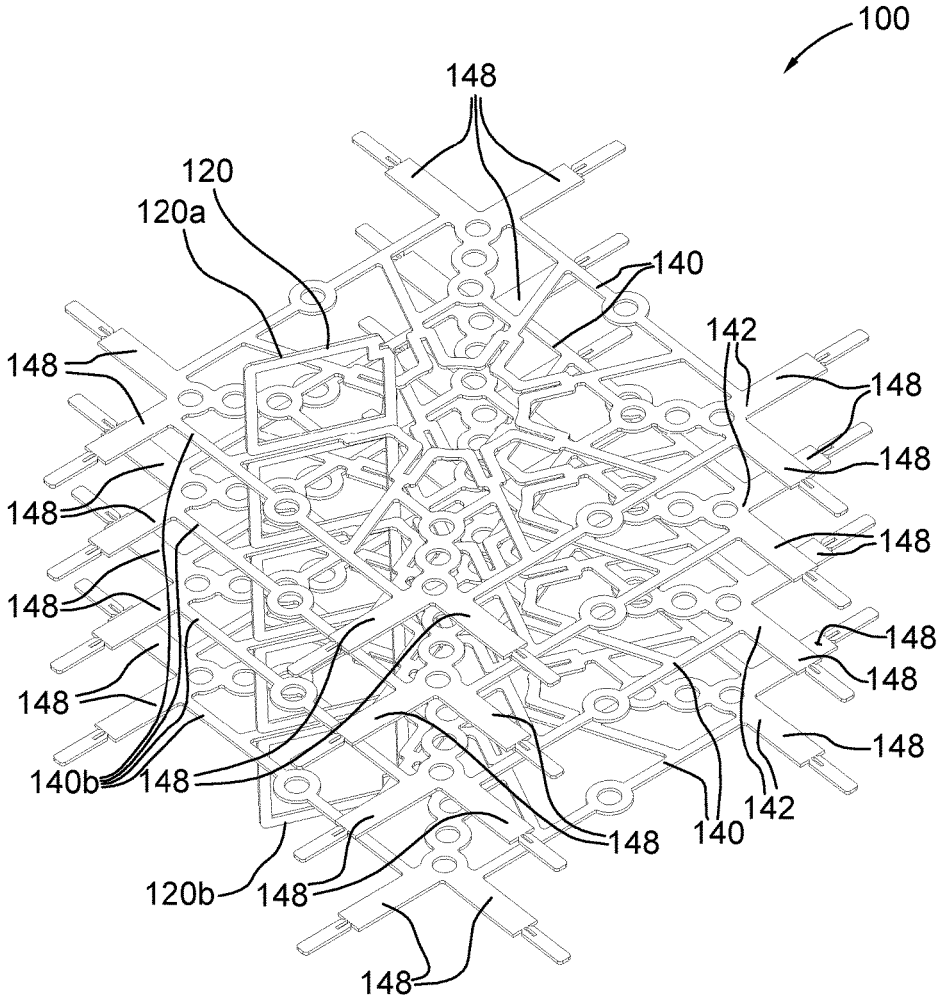
FIG. 13 is a perspective view similar to FIG. 12, but with a fourth rib plate also slidably connected in seriatim to the leg member of FIG. 8.

Also, similarly, as can be seen in FIG. 13, a fourth one of the rib plates 140 has been slid vertically into place such that the leg-engagement slot 150 of the rib plate 140 and one of the top rib plate engagement slot 130 of the leg member 120 are aligned one with the other. The leg-engagement slot 150 is then slidingly interfit within the rib-engagement slot 130 to securely connect the second rib plate 140 to the leg member 120 to continue to form the metal skeleton 100.

Figure 14:
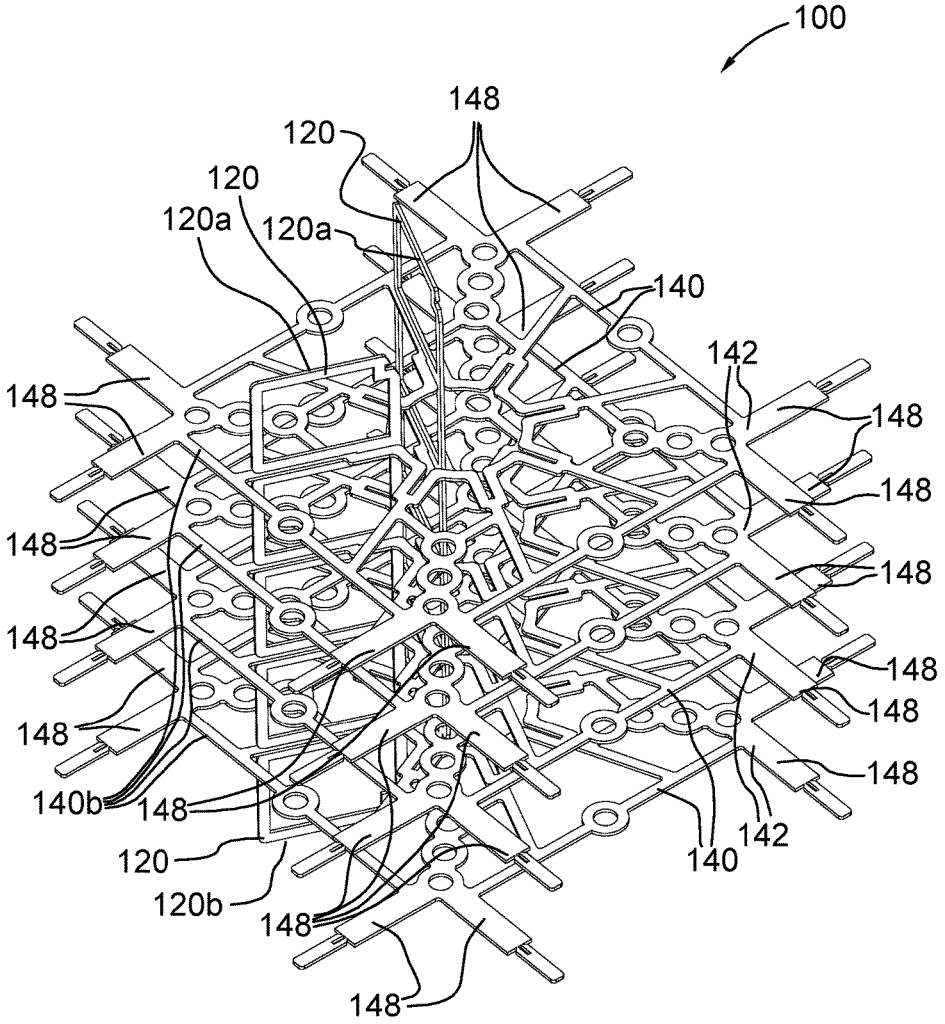
FIG. 14 is a perspective view similar to FIG. 13, but with a second leg member also slidably connected in seriatim to the four rib plates of FIG. 13.

Reference will now be made to FIG. 14, which shows a second leg member 120 in place. The second leg member 120 has been vertically slid into the post-receiving aperture 140*c* and one set of vertically aligned leg-engagement slots 150 until the rib plate engagement slots 130 of the leg member 120 are aligned with the selected set of the leg-engagement slots 150 of the rib plate 140. The leg-engagement slots 150 are then slidingly interfit within the rib-engagement slots 130 to securely connect the rib plates 140 to the second leg member 120 to continue to form the metal skeleton 100.

Figure 15:
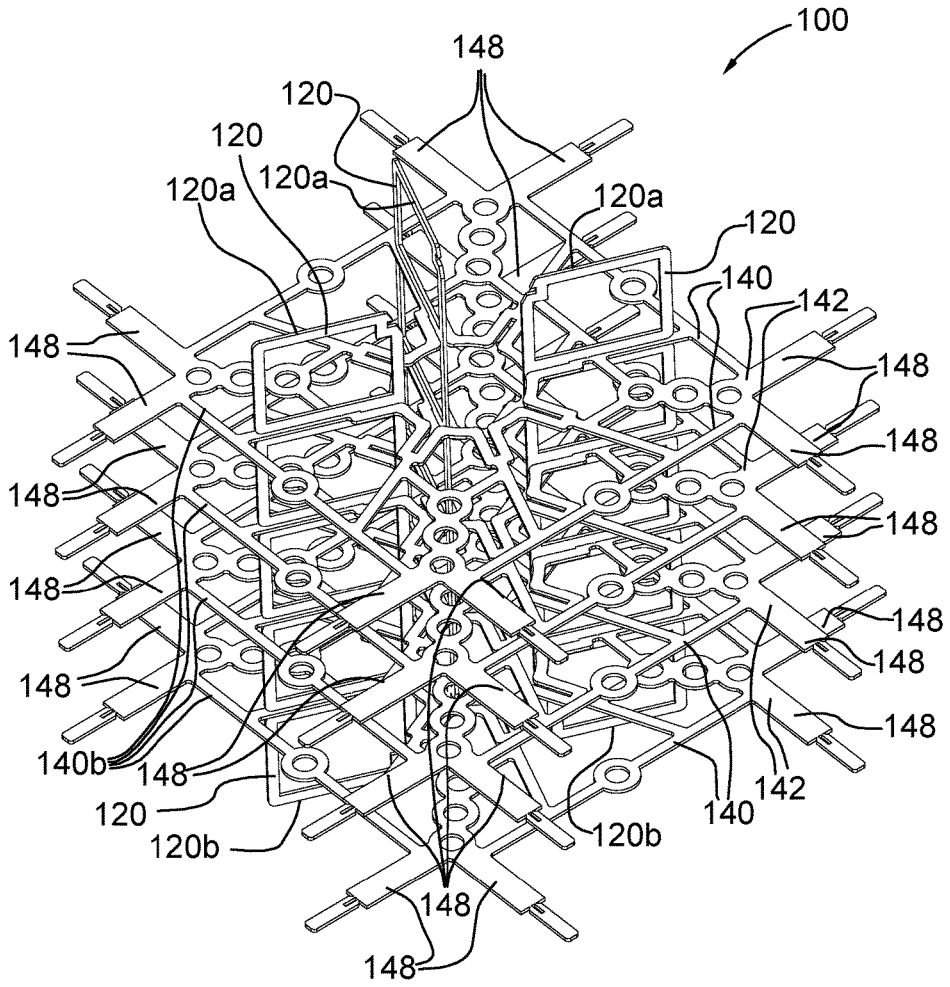
FIG. 15 is a perspective view similar to FIG. 14, but with a third leg member also slidably connected in seriatim to the four rib plates of FIG. 14.
Figure 16:
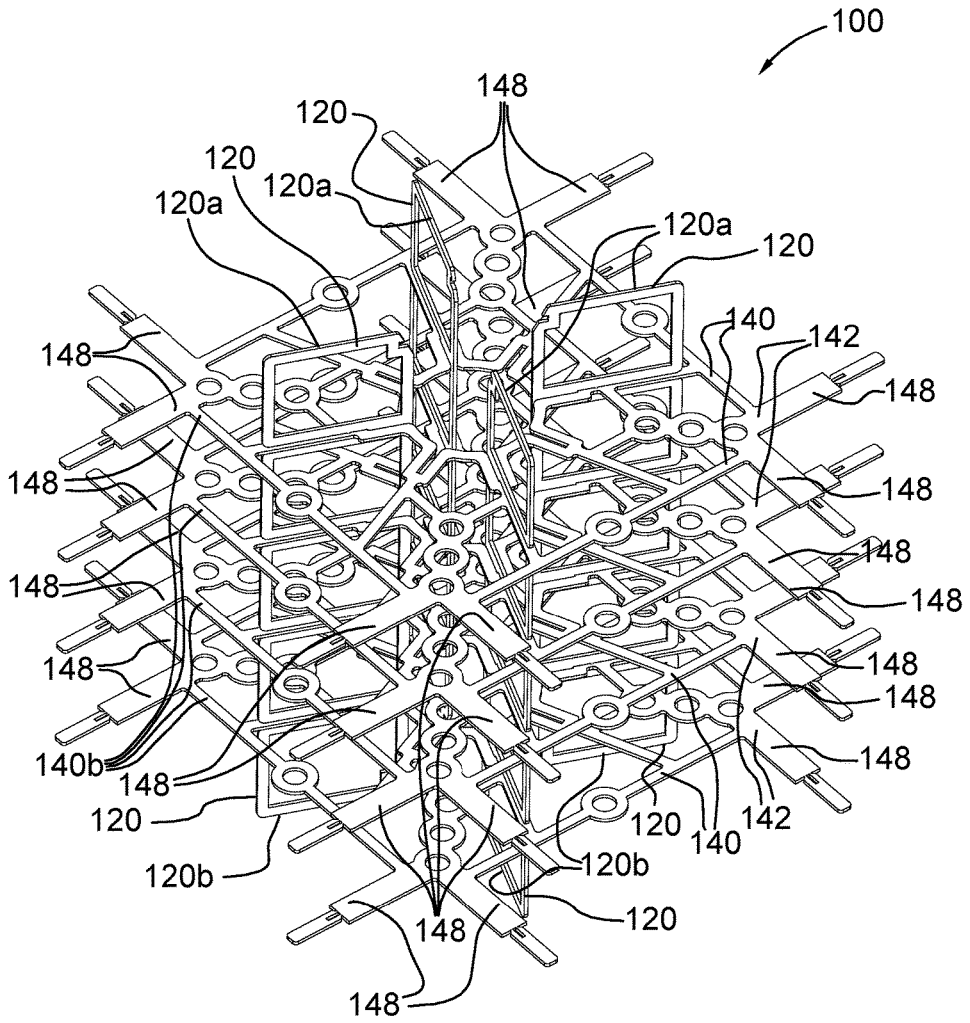
FIG. 16 is a perspective view similar to FIG. 15, but with a fourth leg member also slidably connected in seriatim to the four rib plates of FIG. 15.
Figure 17:
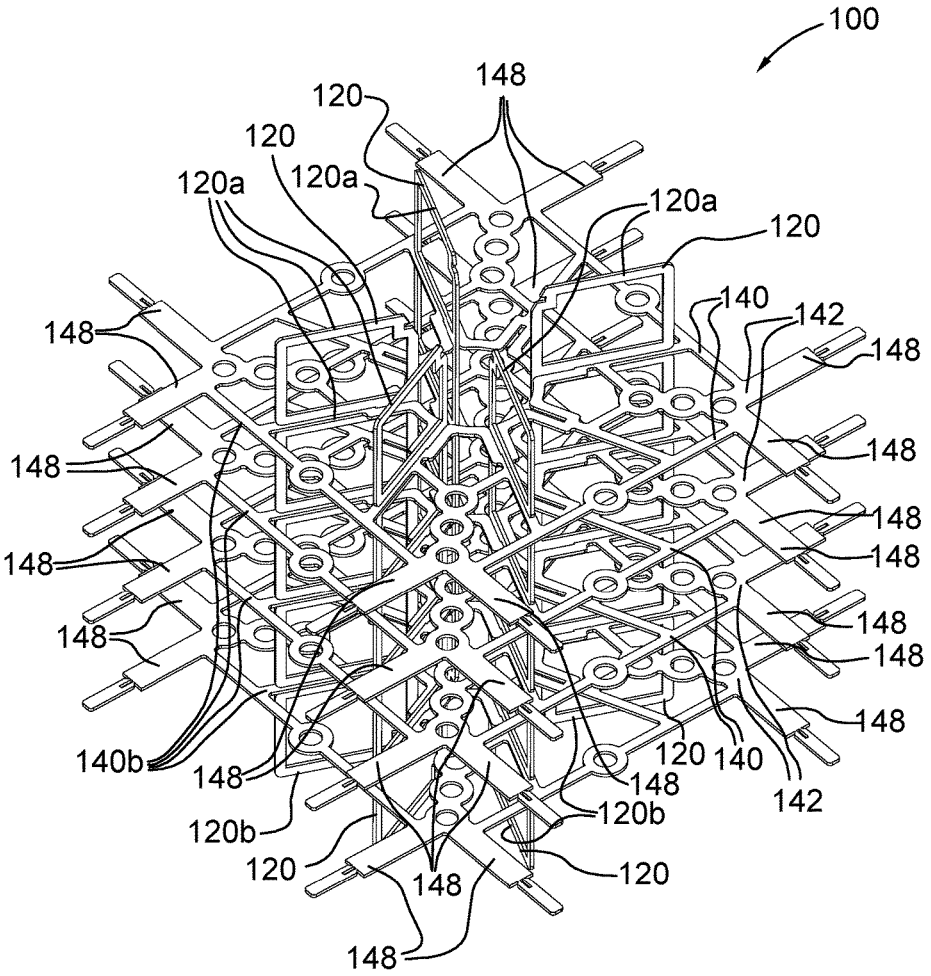
FIG. 17 is a perspective view similar to FIG. 16, but with a fifth leg member also slidably connected in seriatim to the four rib plates of FIG. 16.
Figure 18:
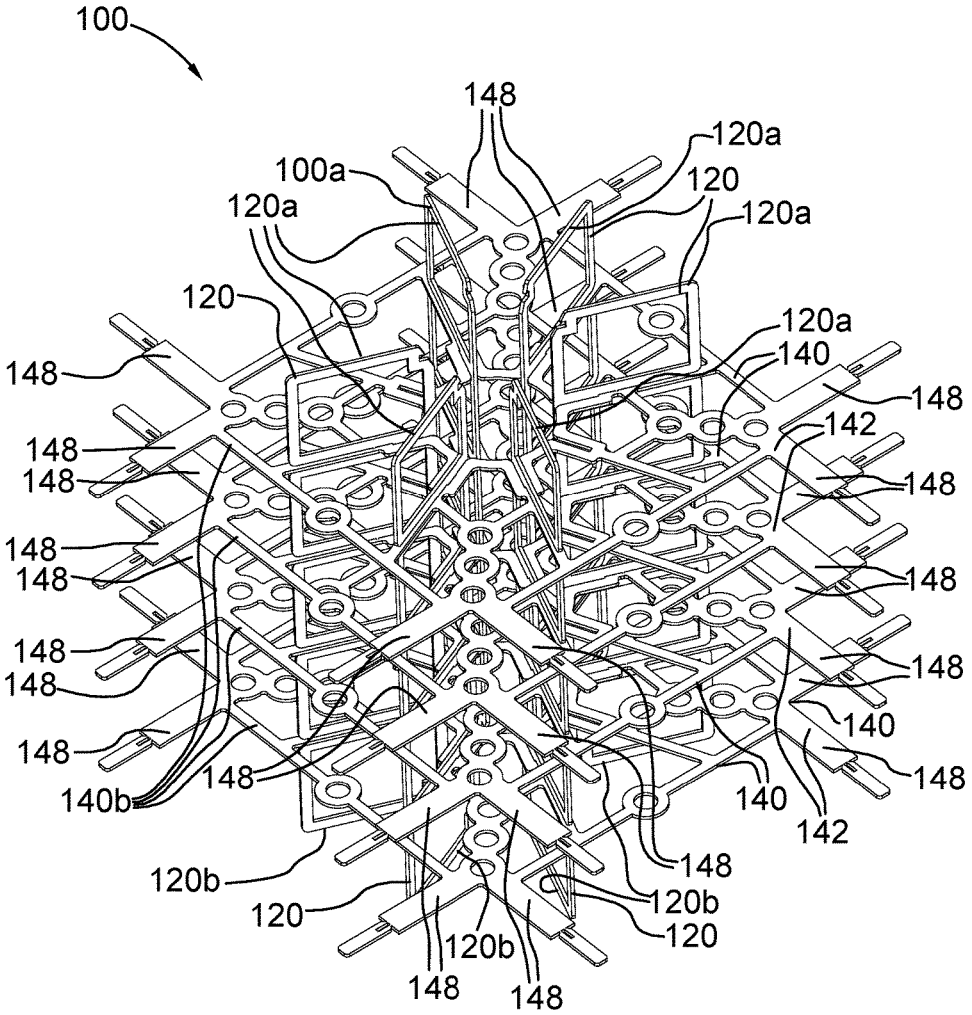
FIG. 18 is a perspective view similar to FIG. 16, but with a sixth leg member also slidably connected in seriatim to the four rib plates of FIG. 17.
Figure 19:
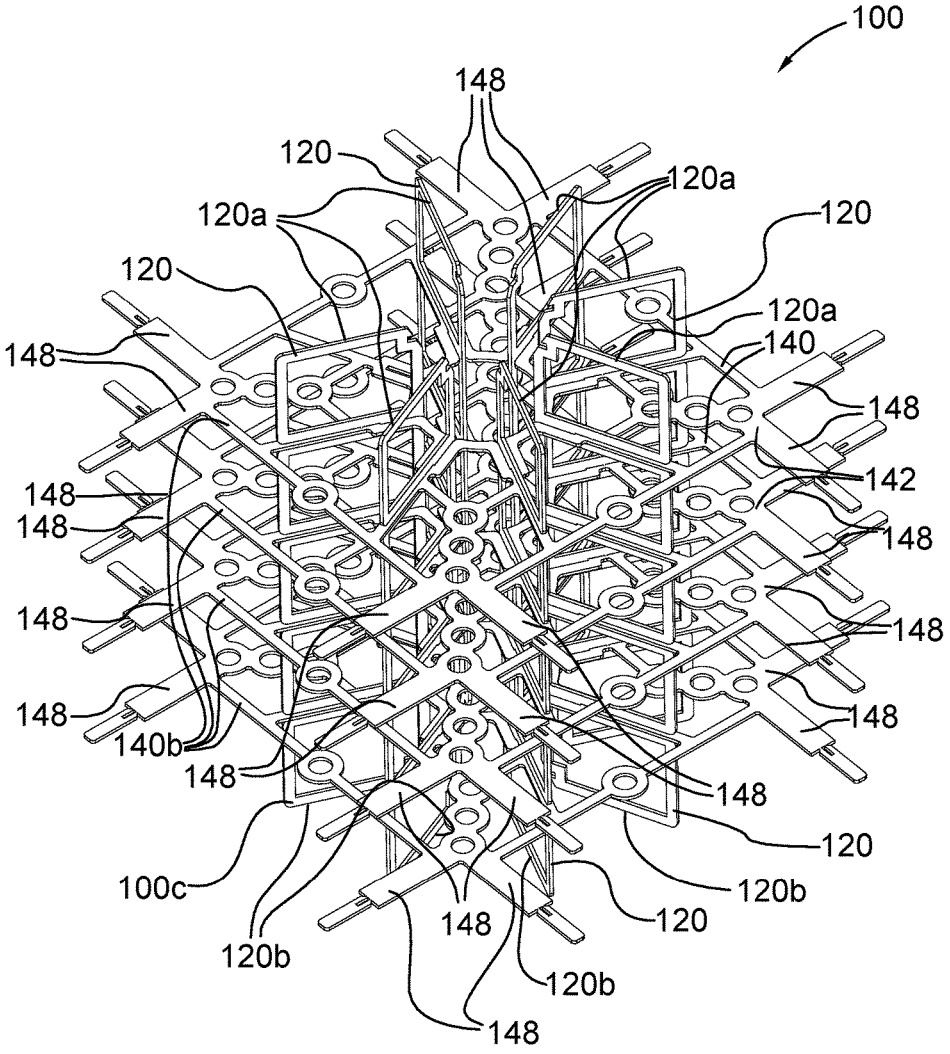
FIG. 19 is a perspective view similar to FIG. 16, but with a seventh leg member also slidably connected in seriatim to the four rib plates of FIG. 18.

As can be seen in FIGS. 15-20, the third through eighth leg members 120 are added in seriatim in the same general manner as described immediately above for the second leg member. More specifically, FIG. 15 shows the third leg member 120 having been added, FIG. 16 shows the fourth leg member 120 having been added, FIG. 17 shows the fifth leg member 120 having been added, FIG. 18 shows the sixth leg member 120 having been added, FIG. 19 shows the seventh leg member 120 having been added, and FIG. 20 shows the eighth leg member 120 having been added, to thereby form the overall basic structure of the metal skeleton 100.

The metal skeleton 100 can be assembled at either a construction site 105 as shown, or remotely from the construction site 105, at an independent assembly site. It is also possible that the metal skeleton 100 can be assembled at a production site remote from the construction site (not specifically shown), such as, for example, the factory where the components of the metal skeleton 100 are originally fabricated. Most commonly, the metal skeleton 100 will be assembled at the construction site 105 in order to minimize transportation costs and transportation effort, and also for the sake of overall efficiency and convenience. In this latter case, the construction site 105 and the assembly site would be one and the same.

In an alternative configuration of a metal skeleton according to the present invention, which configuration is not illustrated, it is contemplated that the first plurality of leg-engagement slots would project into the central body portion of each rib plate from the outer side edge thereof. With this alternative arrangement, each leg member would be rotated through 180 degrees of rotation from the orientation shown in FIG. 8, such that the outer side edge of each leg member would effectively become the operative inner side edge of each leg member. After such rotation, each leg member would, in seriatim, be moved inwardly from adjacent the outer side edge of each rib plate towards the centre of the skeleton structure with consequential sliding interfitment of the first plurality of leg-engagement slots within respective ones of the first plurality of rib-engagement slots, thereby to form the metal skeleton 100. Upper and lower split ring clips could optionally be used in this alternative configuration to respectively engage the upper and lower notches formed in what would now be the outer oriented side edge of each of the leg members, thereby to restrict movement of each of the leg members 120 in an outwardly direction parallel to the plane of the central body portion of the rib plates.

Reference will now be made to FIGS. 23 through 26, which show a second illustrated embodiment of the metal skeleton according to the present invention, as indicated by the general reference numeral 200.

The second illustrated embodiment of metal skeleton 200 is also for the reinforcement of a vertically elongated concrete structure or base (not specifically shown with this embodiment) to be formed therearound and is similar to the first illustrated embodiment of metal skeleton 200 in all material respects, except that the specific shape of the leg members 220, the rib plates 240, and the optional top plate 280 is different so as to, for example, suit this embodiment for use with commercially available, non-metal casting forms, such as cylindrical Sonotube™ casting forms. More particularly, in this regard, the rib plates 240 and the top plate 280 have a substantially circular peripheral plan outline, as compared to a substantially square plan outline in the first illustrated embodiment.

Figure 23:
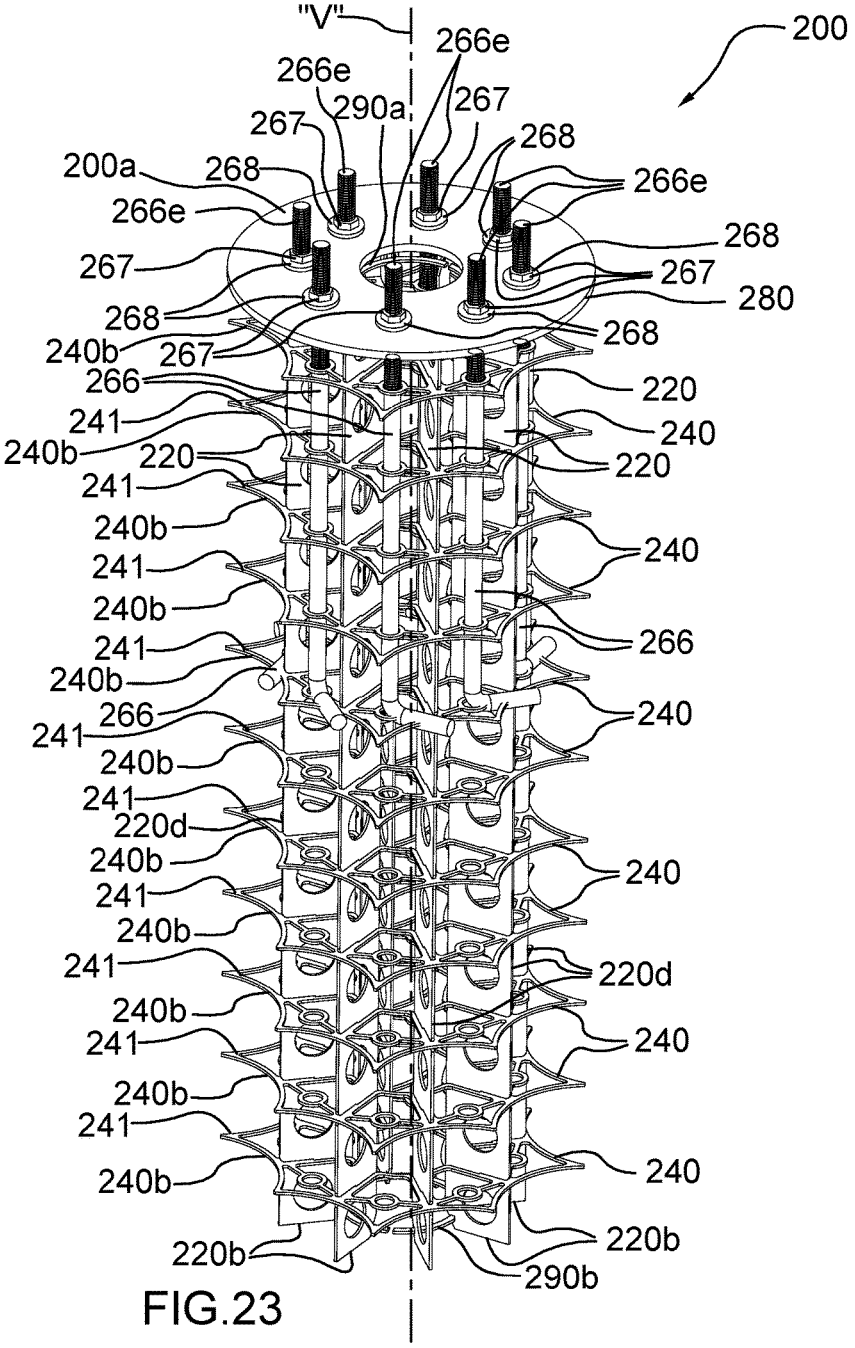
FIG. 23 is a perspective view, in isolation, of a second illustrated embodiment of a metal skeleton according to the present invention.
Figure 24:
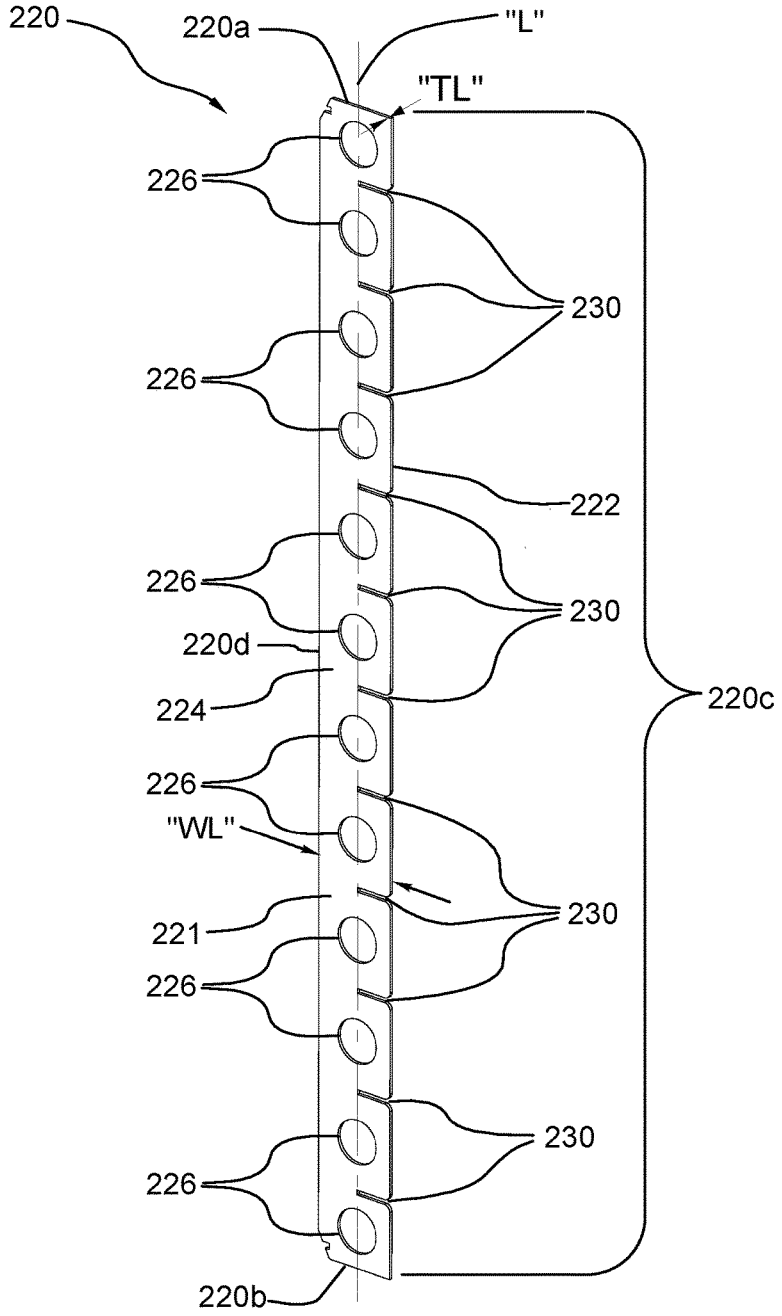
FIG. 24 is a side perspective view, in isolation, of one of the leg members used in the second illustrated embodiment of FIG. 23.
Figure 25:
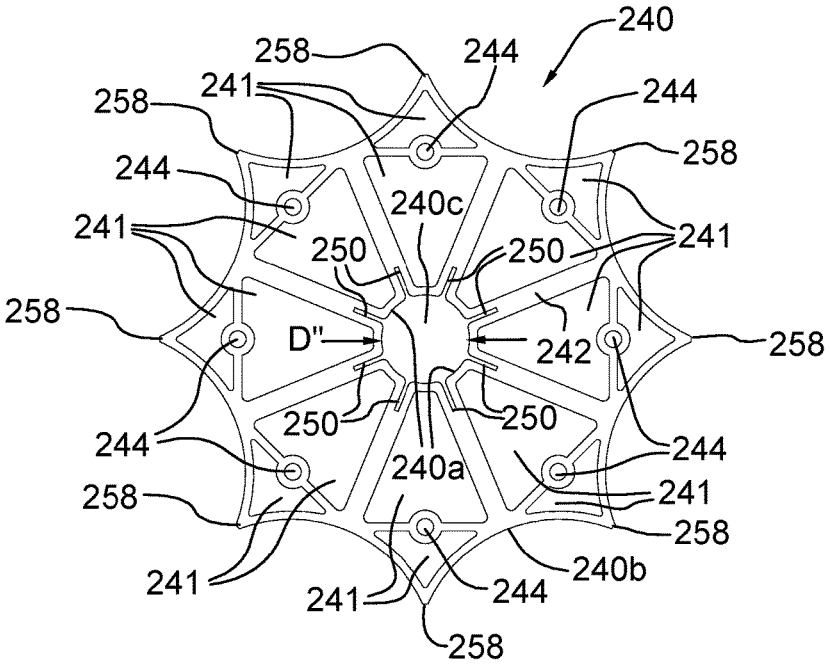
FIG. 25 is a top plan view, in isolation, of one of the rib plates used in the second illustrated embodiment of FIG. 23; and, FIG. 26 is a top plan view of an alternative configuration of a rib plate suitable for substituted use in the second illustrated embodiment of FIG. 23.

As best seen in FIG. 23, the second illustrated embodiment metal skeleton 200 has a generally centrally disposed vertical axis "V" and comprises a first plurality of leg members 220 having rib plate engagement slots 230, a first plurality of rib plates 240 having leg-engagement slots 250, optional "J"-bolts 266, a top plate 280, and upper 290*a* and lower 290*b* split-ring clips.

The first plurality of leg members 220 preferably, but not essentially, comprises eight leg members 220 disposed in substantially equally radially spaced relation around the vertical axis "V" of the metal skeleton 200. Each of the leg members 220 defines a longitudinal axis "L" that, in the second illustrated embodiment, is generally vertically disposed and is therefore substantially parallel to the centrally disposed vertical axis "V" of the metal skeleton 200. Further, each of the leg members 220 has a top end 220*a*, a bottom end 220*b*, an inner side edge 220*c* and an outer side edge 220*d* that all together define a leg body portion 224.

Further, each of the first plurality of leg members 220 has a first plurality of rib plate engagement slots 230 formed in at least one of the inner side edge 220*c* and the outer side edge 220*d*. In the second illustrated embodiment metal skeleton 200, there are, optionally, but not essentially, eleven parallel rib plate engagement slots 230 spaced vertically evenly one from the next formed in the inner side edge 220*c* of each of the eight leg members 220.

The first plurality of rib plates 240 optionally, but not essentially, comprises four rib plates 240. It is contemplated that the first plurality of rib plates 240 could readily comprise from two to perhaps a dozen or more rib plates 240, inclusive, depending upon the specific application intended. The first plurality of rib plates 240 each have an inner peripheral edge 240*a* and an outer peripheral edge 240*b* that together define a generally planar central body portion 242 that has eight similar angular segments. The inner peripheral edge 240*a* of each rib plate 240 defines a post-receiving aperture 240*c* positioned within the central body portion 242 of each the rib plate 240 for insertion of an optional mounting post in the same general manner previously described in relation to the first illustrated embodiment.

Further, the first plurality of rib plates 240 each have a first plurality of leg-engagement slots 250 that project from the inner peripheral edge 240*a* into the central body portion 242. The leg-engagement slots 250 are dimensioned and otherwise adapted to frictionally engage with respective ones of the rib plate engagement slots 230 in the leg members 220. More particularly, the first plurality of leg-engagement slots 250 slidingly interfit within respective ones of the first plurality of rib-engagement slots 230 to securely connect the rib plates 240 to the leg members 220, to form the metal skeleton 200.

The first plurality of rib plates 240 also each have a plurality of openings 241 formed in the central body portion 242 of each rib plate 240 to facilitate the flow of concrete 204 around the first plurality of rib plates 240, as discussed above with reference to the first illustrated embodiment.

In the second illustrated embodiment of metal skeleton 200, the central vertical post is not shown, but any suitable post such as the base pipe 160 as shown in the first illustrated embodiment, could be used with the second embodiment in the same general manner described above in relation to the first illustrated embodiment.

Each of the rib plates 240 also optionally, but not essentially, has a plurality of eight vertically aligned bolt-receiving apertures 244 formed therein arranged in a symmetrical octagonal pattern. In the same manner as the first illustrated embodiment, an equal plurality of eight "J"-bolts 266 may be respectively installed within the vertically aligned bolt-receiving apertures 244, with their straight threaded ends 266*e* extending vertically upwardly through the top plate 280 to facilitate removable mounting of a structure (not shown) atop the top plate 280.

The outer peripheral edge 240*b* of each of the first plurality of rib plates 240 further optionally, but not essentially, defines a plurality of horizontally outwardly projecting bumper members 258 for spacing the metal skeleton 200 relative to a concrete pouring form that is not otherwise attached to the metal skeleton 200. In this manner, the bumper members 258 collectively define an outer cylindrical boundary of the metal skeleton 200 that may be used to snugly engage a cylindrically shaped non-metal casting form, such as a Sonotube™ casting form, that may be positioned around the metal skeleton 200 during the pouring of uncured concrete to form a vertically elongated concrete structure around the metal skeleton 200.

Figure 26:
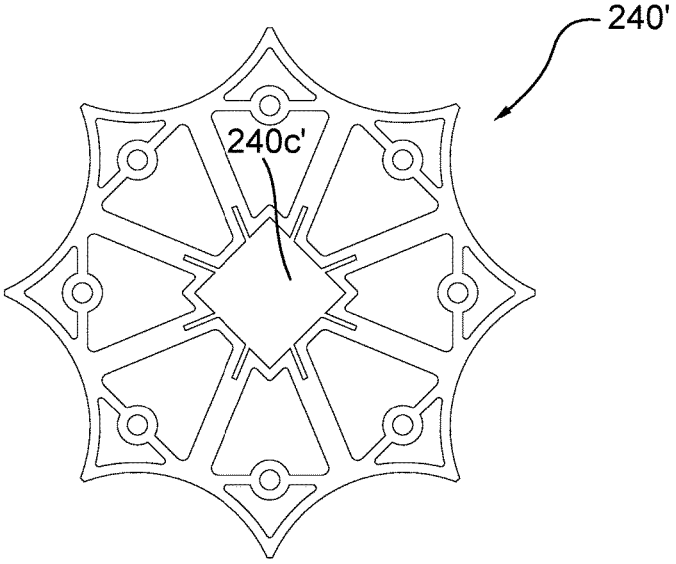

In an alternative optional configuration of a rib plate 240', as illustrated in FIG. 26, it is contemplated that each of the post-receiving apertures 240*c*' may be substantially square in plan outline so as to accept a square base post therewithin. It is further within the scope of the present invention that any other suitable cross-sectional shape of post-receiving apertures and complementary cross-sectional shape of base posts insertable therewithin may be used with similar utility as shown hereinabove.

Other variations are within the spirit of the present invention. Thus, while the invention is susceptible to various modifications and alternative constructions without departing from the spirit of the inventions disclosed and claimed, only a limited number of embodiments thereof have been illustrated in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. The use of any and all examples, or exemplary language (e.g., "such as", "for example", or "preferably") provided herein, is intended merely to better illuminate embodiments of the invention and does not pose a limitation on the scope of the invention unless such limitation is otherwise expressly claimed. No language in the specification should be construed as indicating any non-claimed element as essential to the practice of the invention.

Various embodiments of this invention are described hereinabove. Routine variations of these embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A metal skeleton for the reinforcement of a vertically elongated concrete structure to be formed therearound, the metal skeleton having a vertical axis and comprising:

a first plurality of leg members each having a top end and a bottom end, an inner side edge and an outer side edge together defining a leg body portion, with a first plurality of rib plate engagement slots formed in at least one of the inner side edge and the outer side edge, with each of the leg members being formed from a substantially flat sheet of metal material, with the first plurality of leg members being disposed in radially spaced relation around the vertical axis of the metal skeleton;

a first plurality of rib plates each defining a generally planar central body portion and each having a first plurality of leg-engagement slots projecting into said central body portion, said leg-engagement slots being dimensioned and otherwise adapted to frictionally engage with respective ones of said rib plate engagement slots;

wherein, the first plurality of leg-engagement slots slidingly interfit within respective ones of the first plurality of rib-engagement slots to securely connect the rib plates to the leg members to form the metal skeleton.

2. The metal skeleton of claim 1, wherein the rib plates are formed from flat metal sheet material.

3. The metal skeleton of claim 2, wherein with the central body portion of each rib plate is oriented substantially transversely to the vertical axis.

4. The metal skeleton of claim 3, wherein the rib plates are each positioned within the metal skeleton each with their respective central body portions substantially equidistant one from the next.

5. The metal skeleton of claim 3, wherein each rib plate has an inner peripheral edge from which the first plurality of leg-engagement slots project into the central body portion.

6. The metal skeleton of claim 2, wherein the first plurality of leg-engagement slots project into the central body portion of each rib plate from an outer side edge thereof.

7. The metal skeleton of claim 5, additionally comprising two or more split-ring clips engaging one each an upper portion and a lower portion of the outer side edge and the inner side edge of each of the leg members to restrict movement of each of said leg member in a direction parallel to the central body portions of the rib plates.

8. The metal skeleton of claim 5, wherein the inner peripheral edge of each rib plate defines a post-receiving aperture positioned within the central body portion of each said rib plate.

9. The metal skeleton of claim 8, further comprising a post of complimentary cross-section to the shape of said post-receiving apertures, with the post disposed within one or more said post-receiving apertures with its longitudinal axis in generally parallel relation to the vertical axis of the metal skeleton.

10. The metal skeleton of claim 9, wherein said post is disposed in snug-fitting relation within said one or more post-receiving apertures.

11. The metal skeleton of claim 10, wherein each of the post-receiving apertures is substantially circular in plan outline.

12. The metal skeleton of claim 10, wherein each of the post-receiving apertures is substantially square in plan outline.

13. The metal skeleton of claim 8, wherein each of the first plurality of leg-engagement slots is disposed in vertically aligned relation with another one of the first plurality of leg-engagement slots in each of the vertically adjacent ones of the first plurality of rib plates.

14. The metal skeleton of claim 8, wherein the post-receiving apertures of the first plurality of rib plates are centrally positioned within the central body portion of each rib plate.

15. The metal skeleton of claim 14, wherein the post-receiving apertures of the first plurality of rib plates are substantially vertically aligned each with the others.

16. The metal skeleton of claim 8, wherein the post-receiving apertures in the first plurality of rib plates are substantially each the same size as the others.

17. The metal skeleton of claim 2, wherein each of the first plurality of leg members defines a longitudinal axis, and wherein when the rib plates are securely connected to the leg members, each said longitudinal axis is oriented substantially transversely to the central body portions of each of the rib plates.

18. The metal skeleton of claim 1, wherein the first plurality of leg members are disposed in substantially equally radially spaced relation around the vertical axis of the metal skeleton.

19. The metal skeleton of claim 1, wherein the first plurality of leg members comprises from three leg members to eight leg members, inclusive.

20. The metal skeleton of claim 2, wherein the bottom ends of the first plurality of leg members define a base for engaging a substantially horizontal receiving surface to thereby permit the metal skeleton to freely and stably stand on the substantially horizontal receiving surface.

21. The metal skeleton of claim 2, wherein the first plurality of leg members each has first and second opposed faces and a thickness defined between said first and second opposed faces, and a width defined between said inner side edge and said outer side edge thereof, and wherein the width is between twenty to one hundred times greater than the thickness.

22. The metal skeleton of claim 2, wherein the first plurality of leg members each have a plurality of openings formed therein to facilitate the flow of concrete around the first plurality of leg members.

23. The metal skeleton of claim 22, wherein said openings are disposed in said first plurality of leg members between adjacent ones of said rib plate engagement slots.

24. The metal skeleton of claim 2, wherein each of the rib plates has a plurality of vertically aligned bolt-receiving apertures formed therein.

25. The metal skeleton of claim 24, wherein said plurality of bolt-receiving apertures comprises four bolt receiving apertures.

26. The metal skeleton according to claim 25, wherein said four bolt receiving apertures are arranged in a square pattern.

27. The metal skeleton of claim 24, wherein said plurality of bolt-receiving apertures comprises eight bolt receiving apertures.

28. The metal skeleton of claim 27, wherein said eight bolt receiving apertures are arranged in a symmetrical octagonal pattern.

29. The metal skeleton according to claim 24, further comprising an equal plurality of "J"-bolts having their straight threaded ends extending vertically through said bolt-receiving apertures beyond the top ends of said first plurality of leg members.

30. The metal skeleton of claim 29, further comprising a top plate resting on the top ends of said first plurality of leg members and having an equal plurality of bolt-receiving apertures formed therein to each receive one of said straight threaded ends of said "J"-bolts in respective throughpassing relation, thereby to provide for securement of the top plate to the metal skeleton by means of threaded fasteners engaging the straight threaded ends of said "J"-bolts extending through said bolt-receiving apertures formed in the top plate.

31. The metal skeleton of claim 2, wherein each of said first plurality of rib plates has one or more horizontally outwardly projecting weight-bearing tabs adapted to retain concrete pouring forms in weight-supported relation on said weight-bearing tabs during the forming of said vertically elongated concrete structure.

32. The metal skeleton of claim 31, further comprising a plurality of concrete pouring forms each having at least one aperture formed therein so as to be hangable on said outwardly projecting weight-bearing tabs.

33. The metal skeleton of claim 32, wherein each of said outwardly projecting weight-bearing tabs has a narrower width end portion and a shoulder between the narrower width end portion and the remainder of each outwardly projecting weight-bearing tab defines at least one stop surface, and wherein said concrete pouring form bears against said at least one stop surface when in place.

34. The metal skeleton of claim 33, wherein said narrower width end portion of each outwardly projecting weight-bearing tab has at least one wedge-receiving aperture therein that receives a respective securing wedge therein to hold the concrete pouring form in place during pouring and curing of concrete around said metal skeleton.

35. The metal skeleton of claim 34, wherein said securing wedge is removable from said at least one wedge-receiving aperture subsequent to said pouring and curing of concrete.

36. The metal skeleton of claim 2, wherein an outer side edge of each of said first plurality of rib plates further defines a plurality of horizontally outwardly projecting bumper members for spacing the metal skeleton relative to a concrete pouring form that is not otherwise attached to the metal skeleton.

37. The metal skeleton of claim 2, wherein the first plurality of rib plates each has a plurality of opening spaces formed in the body of each rib plate to facilitate the flow of concrete around the first plurality of rib plates.

38. The metal skeleton of claim 2, wherein each of the first plurality of rib plates has an inner peripheral edge that defines a post-receiving aperture therein, and wherein each of the plurality first of leg members has a width defined between said inner side edge and said outer side edge thereof, and wherein the width of each of the first plurality of leg members is less than the diameter of said post-receiving aperture in said plurality first of leg members.

* * * * *